US011175004B2

(12) United States Patent
Chokshi et al.

(10) Patent No.: US 11,175,004 B2
(45) Date of Patent: Nov. 16, 2021

(54) COVE LIGHTING MOUNTING SYSTEMS AND METHODS

(71) Applicant: ABL IP Holding LLC, Atlanta, GA (US)

(72) Inventors: Sparsh Chokshi, Duluth, GA (US); Jeremy Stone, Atlanta, GA (US); Kaitlyn T. Crawford, Atlanta, GA (US); Kristen A. Aceto-Netemeyer, Decatur, GA (US); Arvind Kashogi, Chamblee, GA (US)

(73) Assignee: ABL IP Holding LLC, Atlanta, GA (US)

( * ) Notice: Subject to any disclaimer, the term of this patent is extended or adjusted under 35 U.S.C. 154(b) by 0 days.

(21) Appl. No.: 16/851,717

(22) Filed: Apr. 17, 2020

(65) Prior Publication Data

US 2021/0325011 A1 Oct. 21, 2021

(51) Int. Cl.

| | |
|---|---|
| ***F21S 8/00*** | (2006.01) |
| ***F21V 17/16*** | (2006.01) |
| ***F21S 2/00*** | (2016.01) |

(52) U.S. Cl.

CPC ..... *F21S 8/036* (2013.01); *F21S 2/005* (2013.01); *F21S 8/037* (2013.01); *F21V 17/164* (2013.01)

(58) Field of Classification Search

CPC ..... F21V 21/02; F21V 21/34; F21V 17/164; F21S 8/036; F21S 2/005; F21S 8/037

See application file for complete search history.

(56) References Cited

U.S. PATENT DOCUMENTS

| | | | | |
|---|---|---|---|---|
| 7,210,272 | B2 * | 5/2007 | Friday | E04F 19/0436 52/211 |
| 9,062,840 | B2 * | 6/2015 | Swisha | F21S 8/033 |
| 10,180,219 | B1 | 1/2019 | Lahner et al. | |
| 10,203,077 | B1 * | 2/2019 | Bremser | F21S 8/037 |
| 10,598,321 | B2 * | 3/2020 | Campbell | F21S 8/037 |
| 10,808,918 | B1 * | 10/2020 | Lahner | F21V 21/02 |
| 10,859,220 | B2 * | 12/2020 | Hollander | F21S 8/033 |
| 2009/0129093 | A1 | 5/2009 | Wittig et al. | |
| 2017/0343194 | A1 | 11/2017 | Campbell et al. | |

* cited by examiner

*Primary Examiner* — Matthew J. Peerce
(74) *Attorney, Agent, or Firm* — Kilpatrick Townsend & Stockton LLP

(57) ABSTRACT

A cove lighting system includes a plurality of cove extrusions and a plurality of mounting brackets. Each cove extrusion is a single extrusion defining a cove channel and mounting features. The mounting brackets are attached to the wall and the cove extrusions are hung from the mounting brackets with the mounting features. The cove extrusions are hung immediately adjacent to each other to define a continuous cove channel to receive one or more power boxes, and one or more luminaires.

16 Claims, 35 Drawing Sheets

COVE LIGHTING MOUNTING SYSTEMS AND METHODS

FIELD OF INVENTION

The present technology relates to the field of wall-mounted lighting fixtures, and more particularly to systems, apparatuses, and methods related to installing cove lighting fixtures.

BACKGROUND OF THE INVENTION

Cove lighting fixtures are used in residential and commercial locations and may be used for various illumination purposes, including wall wash illumination, and general ambient illumination. Cove lighting fixtures may be used to provide indirect lighting using an open channel along a wall. For example, cove lighting fixture may be near a ceiling. Lighting elements are mounted within the channel so that the emitted light is directed toward a wall and/or ceiling. Installing a cove lighting fixture may involve building a channel with conventional building techniques such as framing, sheetrocking/plastering, and/or may involve using cove lighting systems which comprise multiple separate pieces used to define the cove. The techniques are disadvantageous due to the amount of skill and labor needed to fabricate the cove at the installation site.

SUMMARY OF THE INVENTION

A cove lighting system includes a plurality of cove extrusions and a plurality of mounting brackets. Each cove extrusion is a single extrusion defining a cove channel and mounting features. The mounting brackets are attached to the wall and the cove extrusions are hung from the mounting brackets with the mounting features. The cove extrusions are hung immediately adjacent to each other to define a continuous cove channel to receive one or more power boxes, and one or more luminaires.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION OF THE INVENTION

Figure 1A:
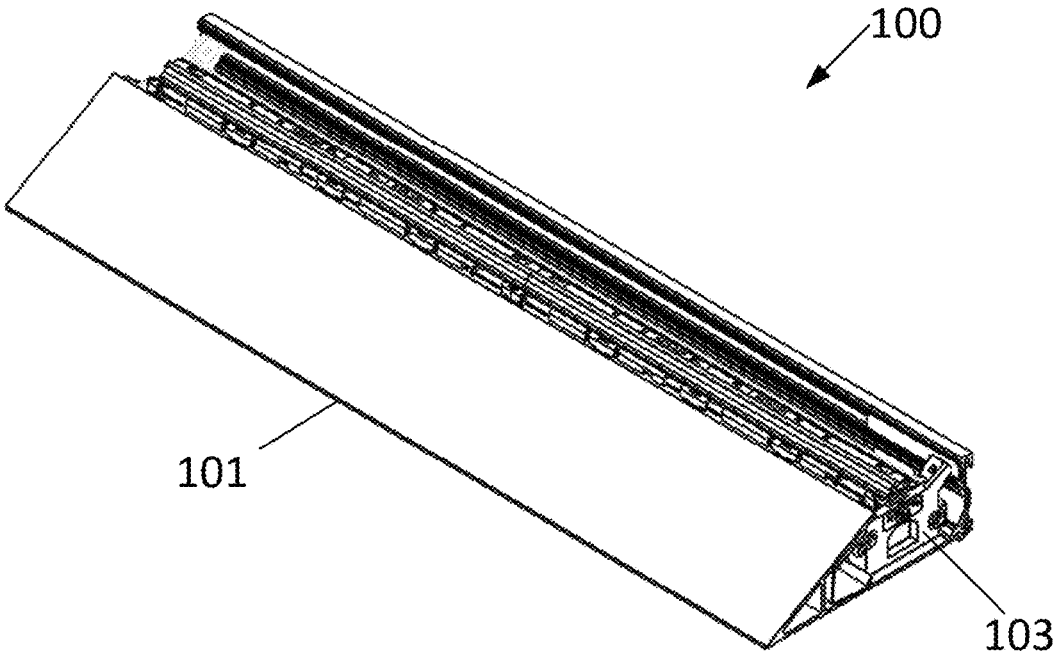
FIGS. 1A-1D show views of a cove lighting system in accordance with embodiments of the disclosed technology.
Figure 1B:
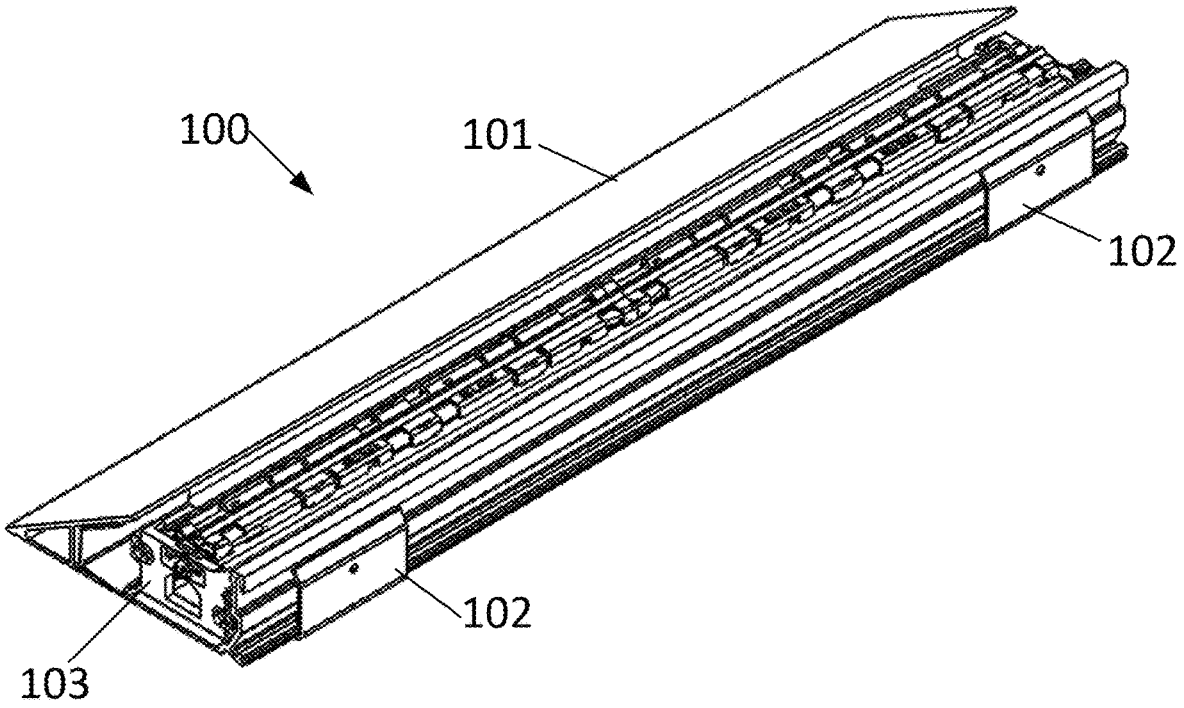
Figure 1C:
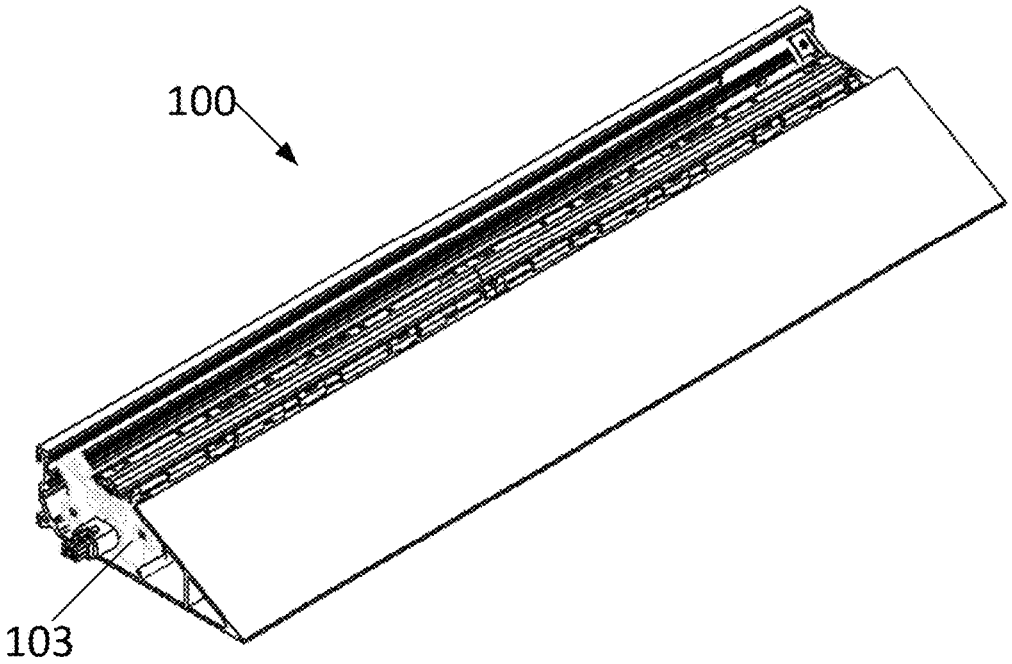
Figure 1D:
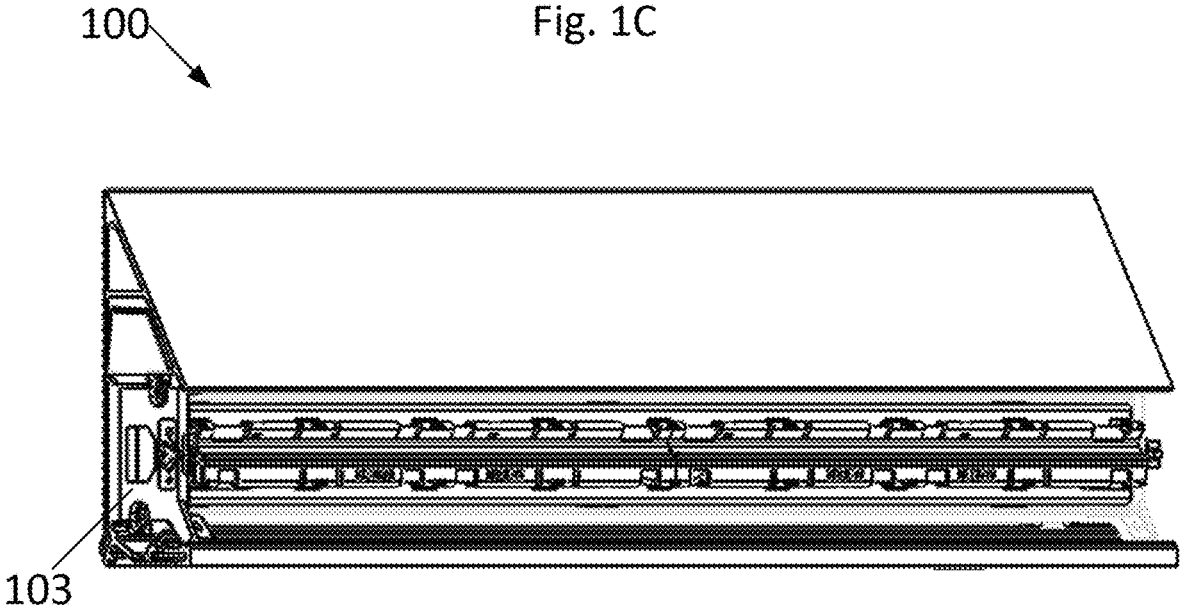

Throughout this description for the purposes of explanation, numerous specific details are set forth in order to provide a thorough understanding of the many aspects and embodiments disclosed herein. It will be apparent, however, to one skilled in the art that the many aspects and embodiments may be practiced without some of these specific details. In other instances, known structures and devices are shown in diagram or schematic form to avoid obscuring the underlying principles of the described aspects and embodiments. Like reference numbers and designations in the various drawings indicate like elements.

FIGS. 1A-1D show embodiments of a cove lighting system 100. As shown the system 100 comprises a cove extrusion 101, a plurality of mounting brackets 102, and a luminaire 103 positioned within a cove channel 105 of the cove extrusion 101. The system 100 may be mounted to a building wall 104 by attaching the mounting brackets 102 to the building wall 104, attaching the cove extrusion 101 to the attached mounting brackets 102, and attaching the luminaire 103 to the cove extrusion 101 after the cove extrusion 101 is attached to the building wall 104.

Cove Extrusion

The cove extrusions as disclosed herein may each be single piece extrusions. A single piece cove extrusion has the advantage of requiring less time/manpower at an installation site as compared to cove lighting systems where the cove is assembled at the installation site. The cove extrusion may be extruded metal, such as aluminum. The single piece cove extrusion comprises a plurality of walls defining inner surfaces, defining the cove channel, and defining outer surfaces.

In embodiments, a cove extrusion 101 comprises a rear wall 201, a bottom wall 202, and a front wall 203 defining an interior cove channel 204. The rear wall 201 comprises an outer surface, opposite an inner surface defining a side of the cove channel. The outer surface of the rear wall 201 comprises bracket mounting features configured to attach the cove extrusion to one or more mounting brackets attached to a building wall. The inner surface of the rear wall may comprise power box and luminaire mounting features.

The bottom wall 202 comprises an outer surface, opposite an inner surface defining a bottom side of the cove channel 204. The outer surface of the bottom wall 202 may be configured to receive a strip of wallboard and/or a layer of skim coat so that the system may have a finish applied to match the adjacent building wall to which the system is mounted. The inner surface of the bottom wall 202 may comprise features for coupling luminaires and power boxes within the cove channel.

The front wall 203 comprises an outer surface, opposite an inner surface defining a front side of the cove channel 204. The outer surface of the front wall 203 may form a 90 degree angle with the bottom wall 202, referred to as a square edge, so that the outer surface faces a horizontal direction. The outer surface of the front wall 203 may form an acute angle with the bottom wall, referred to as a knife edge, so that the outer surface of the front wall 203 faces in a direction that is both horizontal and vertical when the cove extrusion is mounted horizontally on a building wall. The outer surface of the front wall 203 may be generally smooth and configured to receive a finish such as paint. The front wall 203 and bottom wall 202 may define a clip channel 205 sized and shaped to receive a spring clip spanning between adjacent cove extrusions.

Cove extrusions may be formed in straight lengths, for example 6 foot lengths. The cove extrusions may be any length, and a system comprising a plurality of cove extrusions mounted to a building wall may comprise cove extrusions of different lengths in order to achieve any length of system.

Figure 2A:
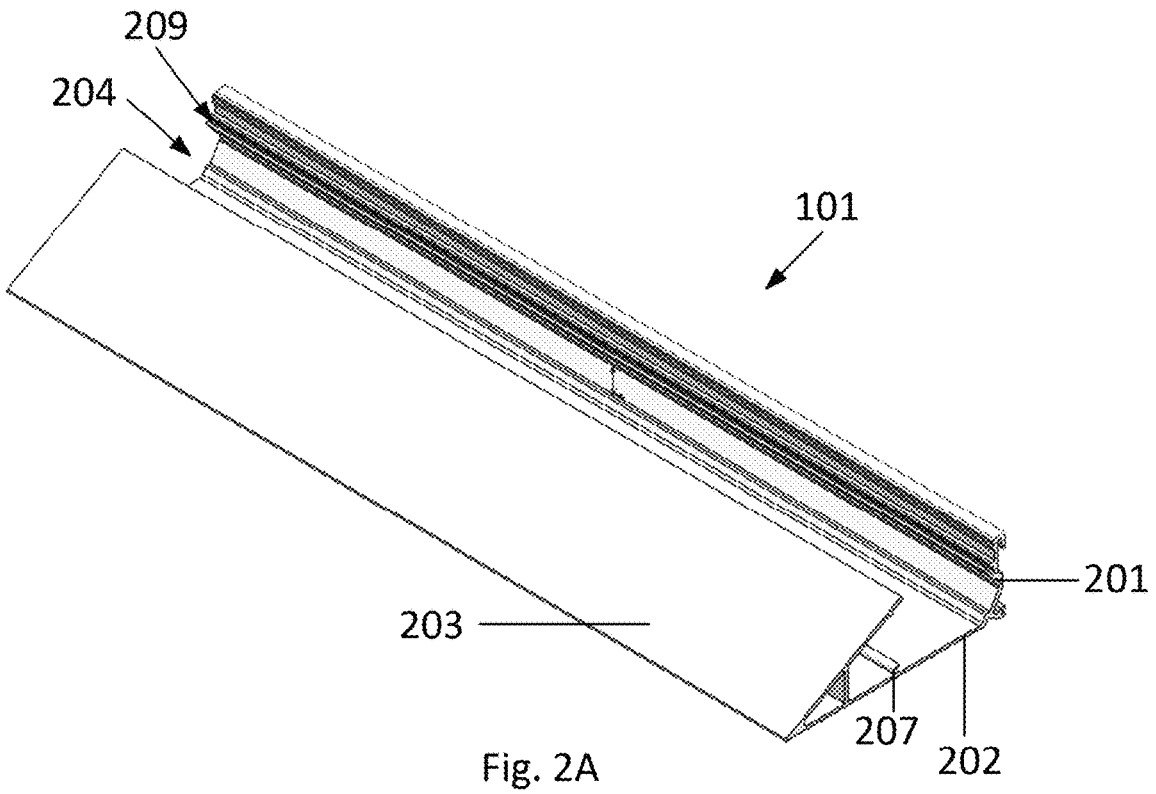
FIGS. 2A-2G show views of a knife edge mud-in cove extrusion in accordance with embodiments of the disclosed technology.

FIGS. 2A-2G show an embodiment of a cove extrusion with a knife edge defined by the bottom wall 202 and the front wall 203. As shown in FIG. 2A, the front wall 203 forms an acute angle with the bottom wall 202 to define the knife edge.

Figure 2B:
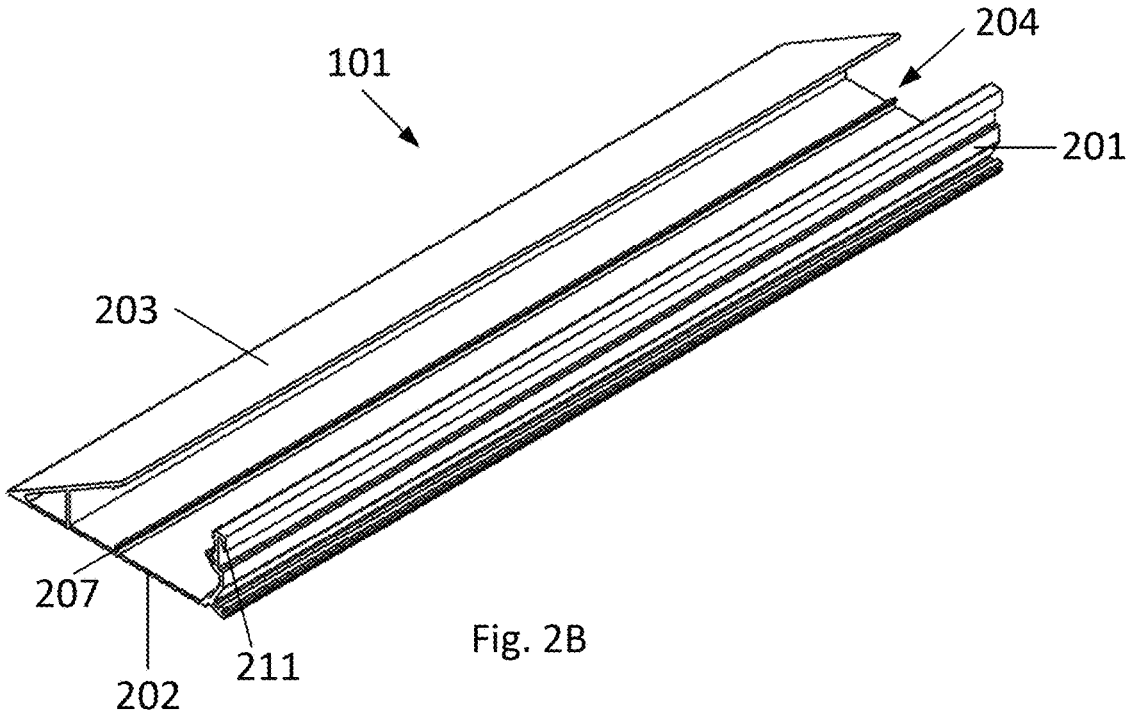
Figure 2C:
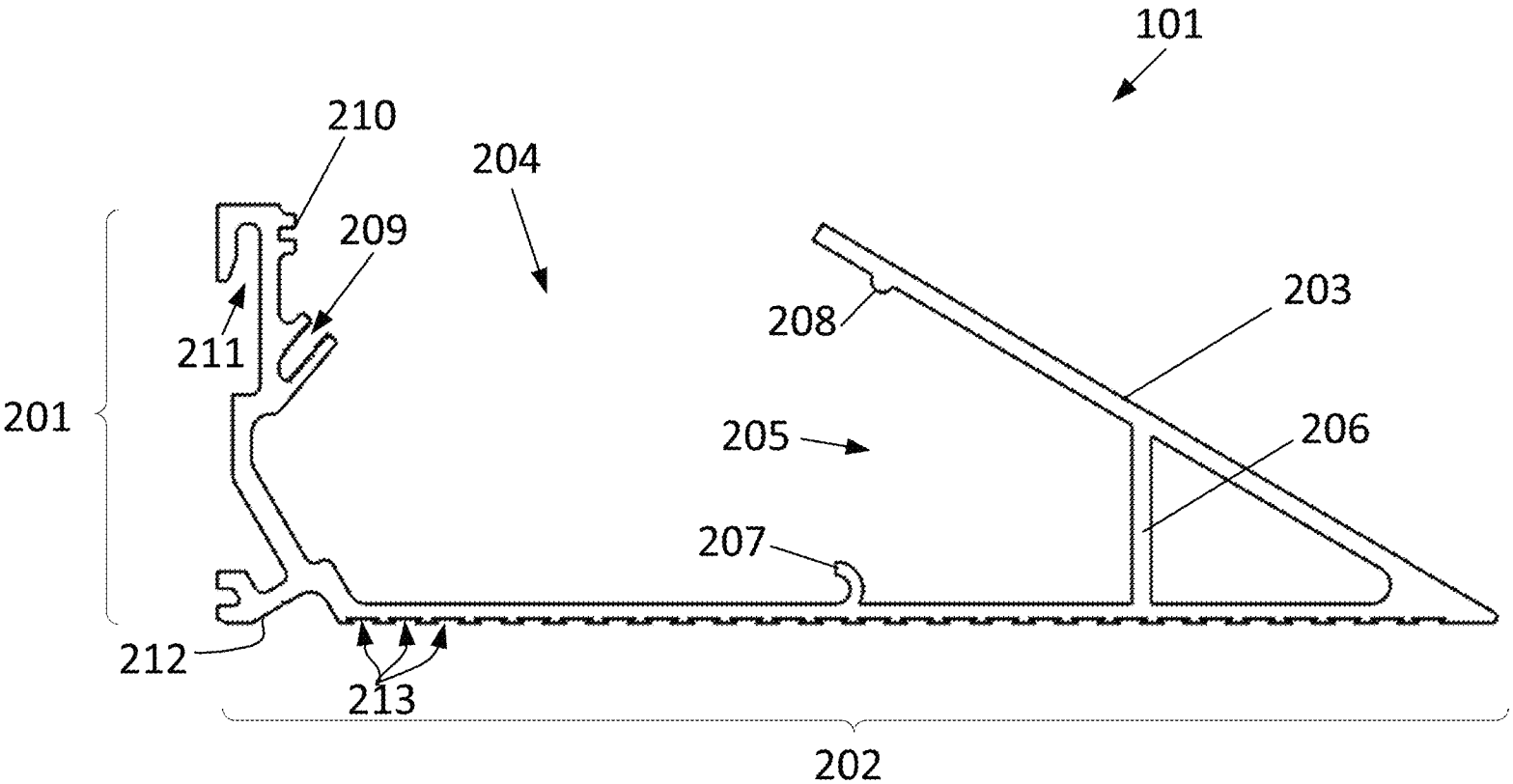
Figure 2D:
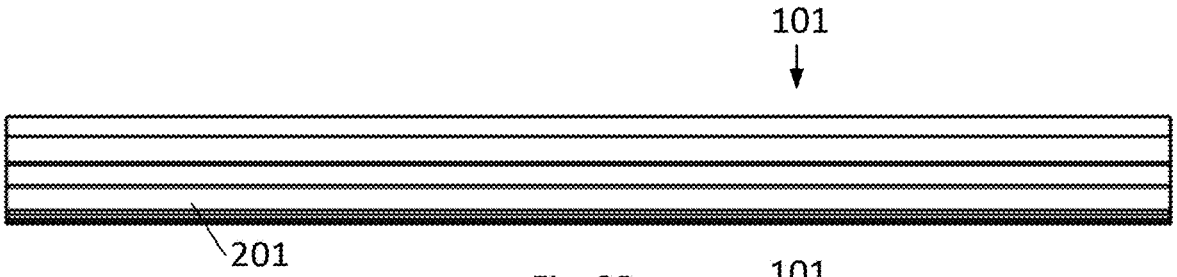
Figure 2E:
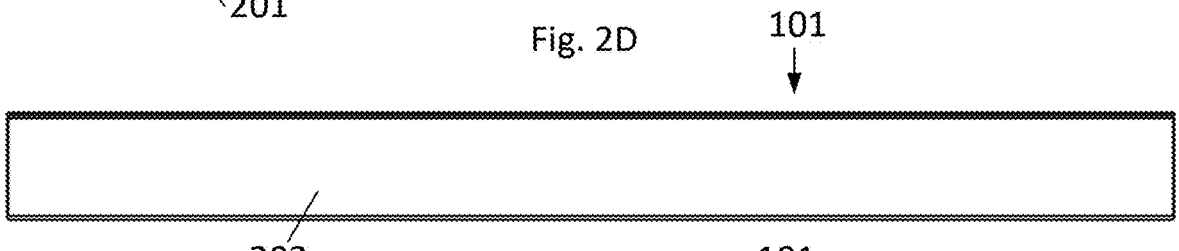
Figure 2F:
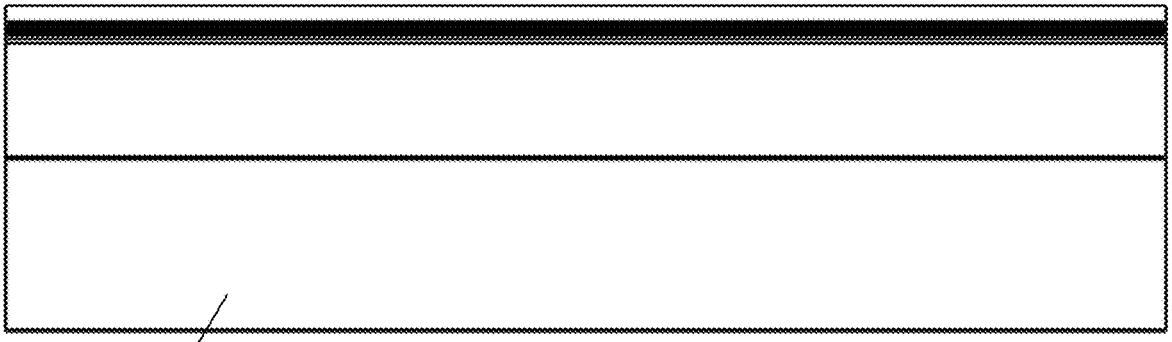

FIG. 2C shows a side profile of the cove extrusion. The left and right side profiles are mirror images of each other due to the extrusion manufacturing process. The features shown in the profile view extend along the length of the cove extrusion. As shown in FIG. 2C, the cove extrusion comprises a rear wall 201, a bottom wall 202, and a front wall 203. Further, in embodiments, cove extrusions may include internal support walls 206. For example as shown in FIG. 2C an internal support wall 206 extends between the front wall 203 and the bottom wall 202 to define a closed internal cavity extending along the length of the cove extrusion. Internal support walls 206 provide rigidity to the cove extrusion and prevent warping, which is advantageous in maintaining alignment of adjacent cove extrusions in a system. In embodiments, the internal support wall 206 is substantially parallel to the rear wall 201, and opposes the rear wall 201 to define portions of the sides of the cove channel, for example as shown in FIG. 2C.

As shown in FIG. 2C, the cove channel 204 is defined between the inner surfaces of the front wall 203, the rear wall 201, and the bottom wall 202. The inner surface of the bottom wall 202 includes a first retaining flange 207 between the support wall and the rear wall 201. The first retaining flange 207 is C-shaped in profile with the first retaining flange initially extending away from the inner surface of the bottom wall 202 and then curving toward the rear wall 201 to form a curved hinge channel. The first retaining flange 207 is configured to act as a hinge and secure foot flanges of power boxes and luminaires, as will be discussed in greater detail below. The inner surface of the front wall includes a second retaining flange 208. The second retaining flange 208 is substantially horizontally aligned with the first retaining flange 207. As shown the second retaining flange 208 is more proximate to an end of the front wall opposite the end of the front wall adjacent the bottom wall 202. A clip channel 205 is defined by as the portion of the cove channel on the side of the first retaining flange 207 opposite the rear wall. The spring clip is held within the clip channel 205 by the first retaining flange 207 and the second retaining flange.

The inner surface of the rear wall 201 defines a fastener channel 209 extending along the length of the cove extrusion as shown in FIG. 2A. The fastener channel 209 is proximate to the opening of the cove channel 204. The fastener channel 209 is configured to receive fasteners at any position along the length of the fastener channel in order to secure power boxes and luminaires to the cove extrusion. In embodiments, the fastener channel may be referred to as a screw chase. As shown in FIGS. 2A and 2C, the fastener channel 209 may be angled in a direction oblique to and facing away from the rear wall 201 and the bottom wall 202.

The inner surface of the rear wall 201 further comprises a dust cover channel 210 configured to receive a dust cover to seal the cove channel 204 from dust and other outside matter that may hinder the performance of the electrical components within the cove channel. The dust cover channel 210 is located toward the top edge of the rear wall 201 so that the dust cover forms a flush top wall between the front wall 203 and the rear wall 201.

The outer surface of the rear wall 201 comprises a bracket channel 211 along a top edge of the rear wall, as shown in FIG. 2C. The bracket channel 211 may face generally downwardly when the cove extrusion is mounted horizontally along a building wall. The bracket channel 211 is configured to act as a hook to allow the cove extrusion 101 to be hung on a mounting bracket 102. The outer surface of the rear wall 201 further comprises a clamping surface 212. The clamping surface 212 may be angled relative to the plane of the rear wall 201. The clamping surface 212 is configured to allow for a fastener passing through the mounting bracket 102 to thread into the cove extrusion 101 and draw the clamping surface 212 against the mounting bracket.

Figure 2G:
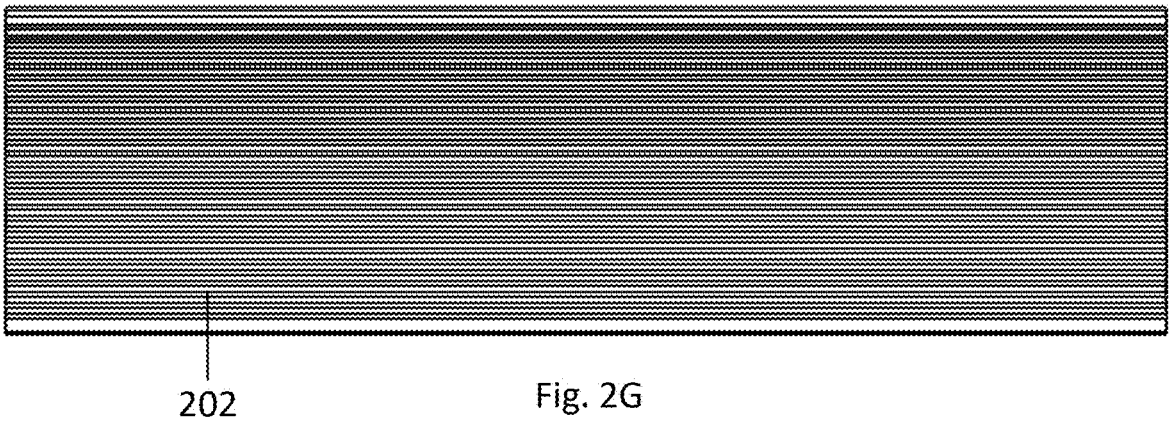

The outer surface of the bottom wall 202 comprises a textured surface in order aid in a skim coat of mud, e.g. joint compound, adhering to the cove extrusion. A single extrusion cove extrusion has the advantage compared to multi component cove system in that single extrusion cove extrusions do not have joints on exterior surfaces formed where different components interface which may cause a skim coat and overlying paint to crack due to slight relative movements of the different components. As shown in FIGS. 2C and 2G the outer surface of the bottom wall 202 comprises a plurality of grooves 213. The plurality of grooves provide the textured surface for the mud to adhere.

FIGS. 2D, 2E, 2F and 2G, show rear, front, top, and bottom views, respectively, of the cove extrusion shown in FIGS. 2A, 2B and 2C.

In embodiments, cove extrusions may be configured to be "mud-in", wherein a layer of mud is applied to the outer surface of the bottom wall prior to applying a surface finish, e.g. paint. Further, in embodiments cove extrusions may be configured to receive a strip of wallboard on the outer surface of the bottom wall and may be referred to as "drywall cove extrusions". FIGS. 3A-3G show an embodiment of a cove extrusion with a knife-edge which shares features of the cove extrusion shown in FIGS. 2A-2G and accordingly shares the same reference numerals identifying the common features. The cove extrusion of FIGS. 3A-3G is a drywall cove extrusion and further comprises features to receive a strip of wallboard on the outer surface of the bottom wall 202.

Figure 3A:
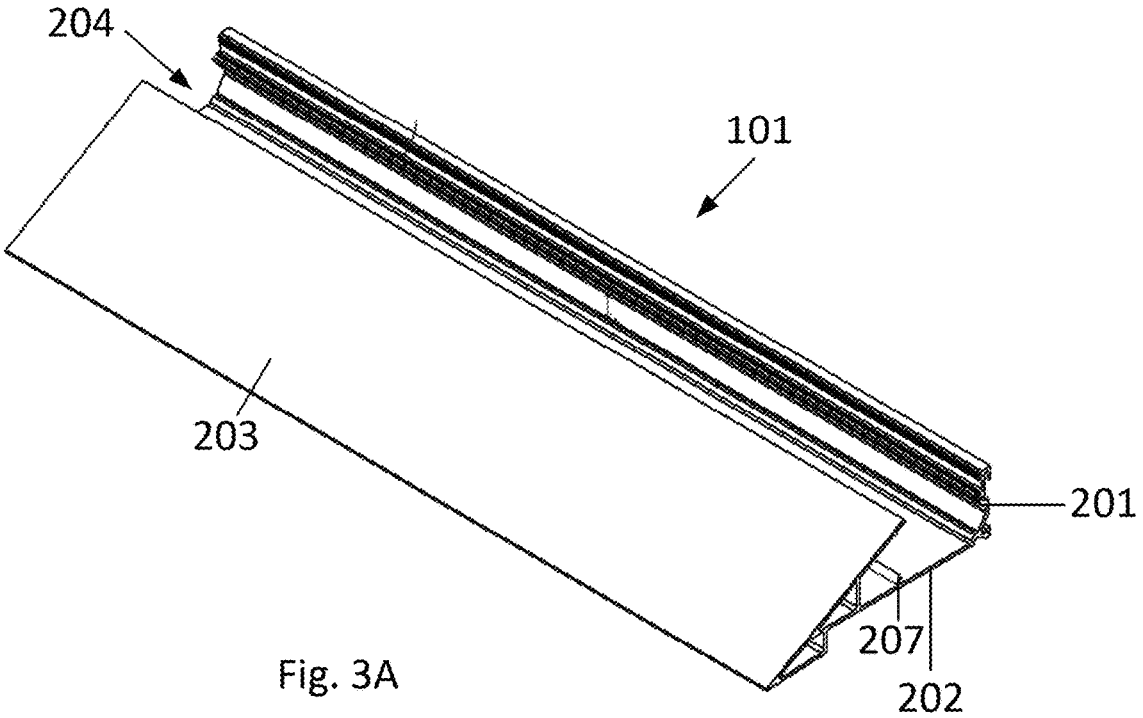
FIGS. 3A-3G show views of a knife edge drywall cove extrusion in accordance with embodiments of the disclosed technology.
Figure 3B:
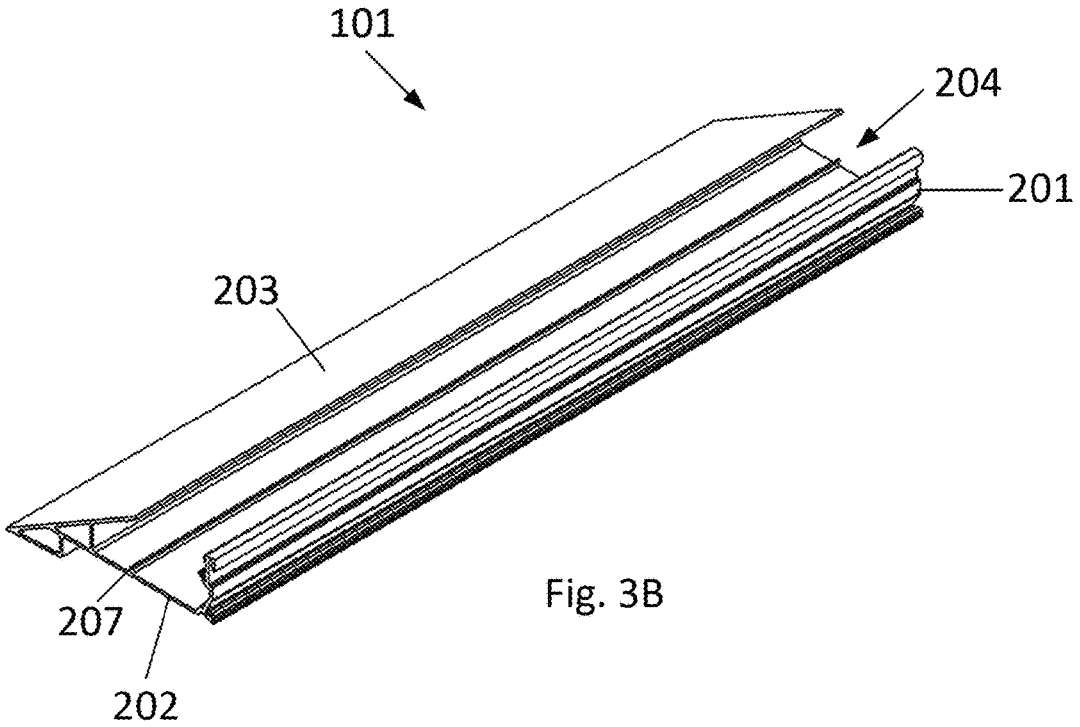
Figure 3C:
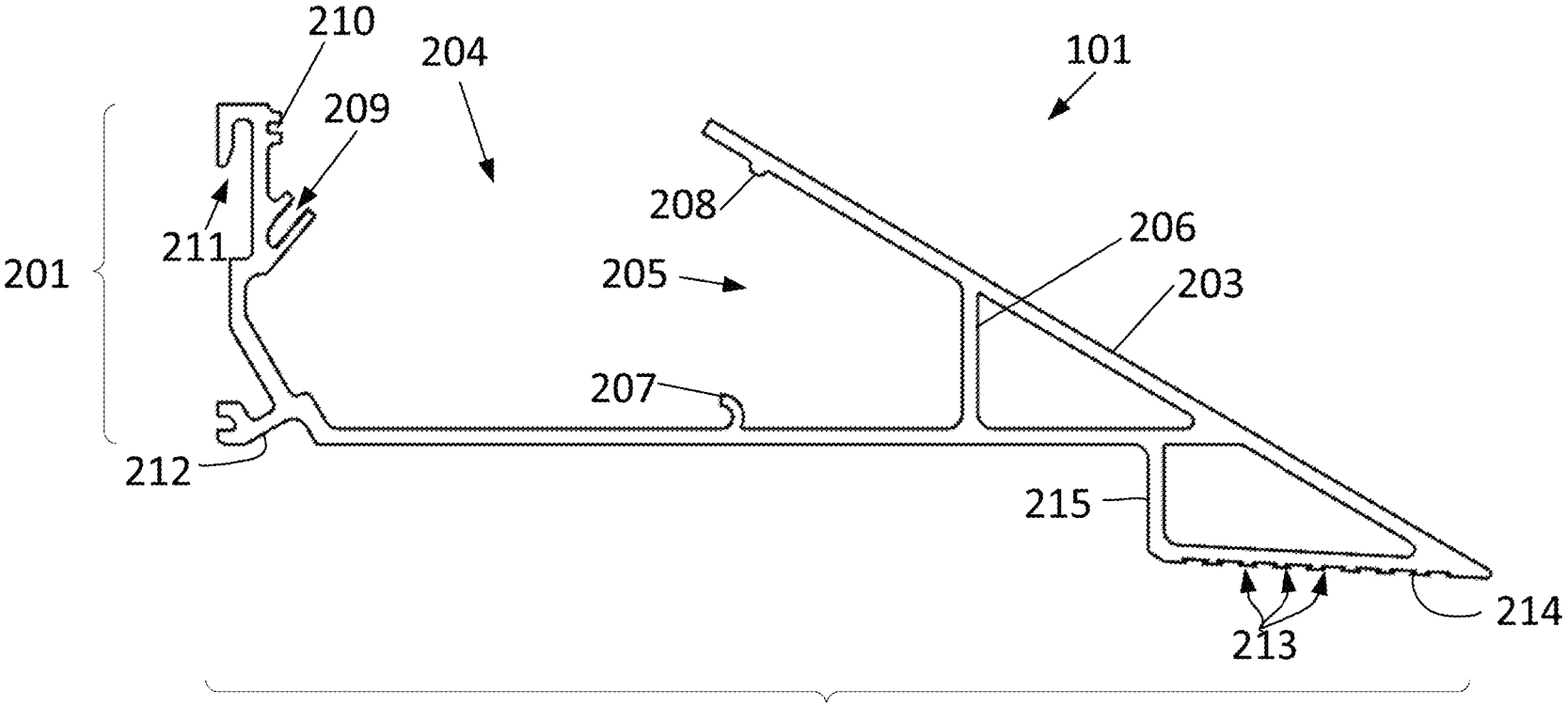
Figure 3D:
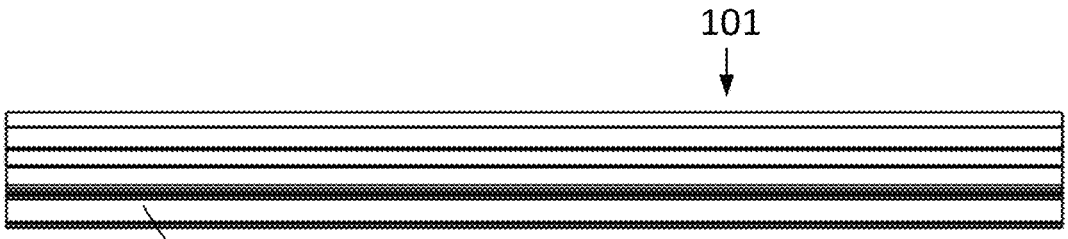
Figure 3E:
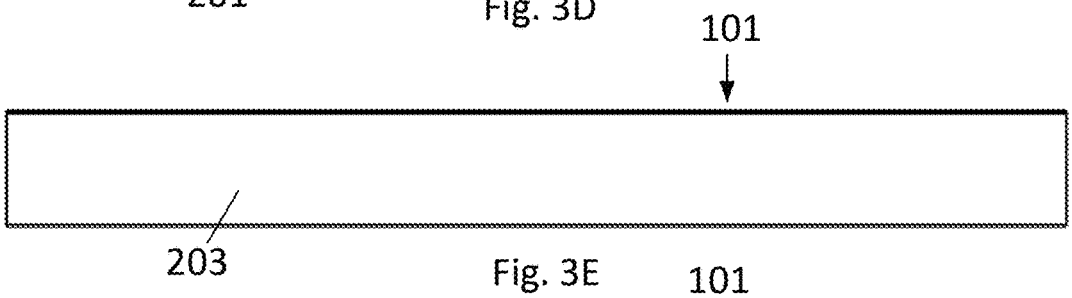
Figure 3F:
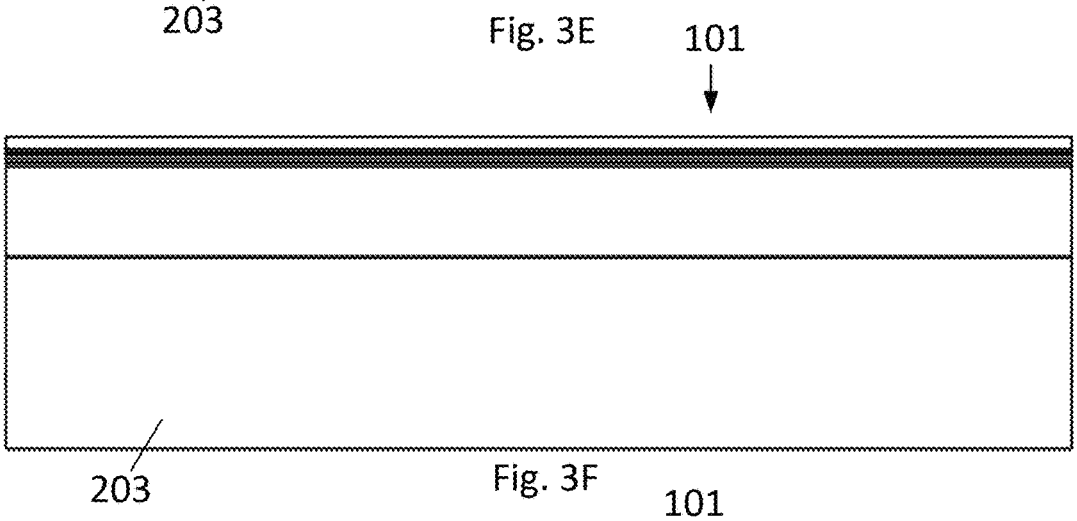
Figure 3G:
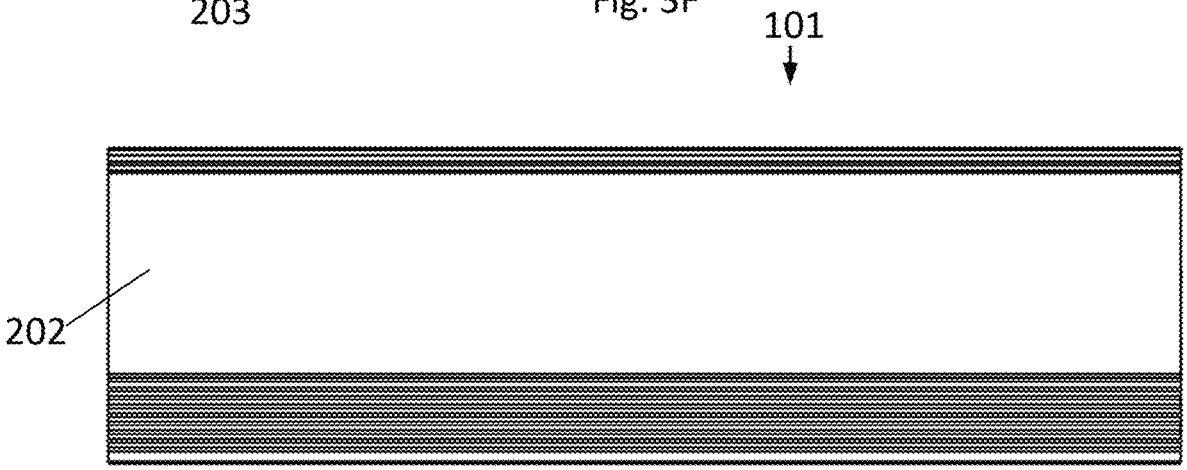

As shown in FIG. 3C, the profile of the cove extrusion includes a front wall 203 extending below the bottom wall 202 and further comprises a front bottom wall 214 and a front rear wall 215. The outer surface of the bottom wall 202 and the front rear wall 215 define a cavity to receive the strip of wallboard. The outer surface of the bottom wall 202 may be smooth to receive an adhesive to adhere the strip of wallboard. The front bottom wall 214 may include a plurality of grooves 213 to receive a skim coat of mud over the front bottom wall and the strip of wallboard.

FIGS. 3D, 3E, 3F and 3G, show rear, front, top, and bottom views, respectively, of the cove extrusion shown in FIGS. 3A, 3B and 3C.

In embodiments, cove extrusions 101 may have a front wall 203 that forms a 90 degree angle with the bottom wall 202 and is vertical when the cove extrusion is mounted horizontally to a building wall, and may be referred to as a square edge cove extrusion. FIGS. 4A-4G show an embodiment of a cove extrusion with a square edge sharing features of the cove extrusions shown in FIGS. 2A-2G. As shown in the profile of FIG. 4C the cove extrusion further comprises an upper portion 216 of the front wall 203. The upper portion 216 of the front wall 203 forms a square angle with the lower portion 217 of the front wall 203, and the lower portion of the front wall forms a square angle with the bottom wall 202.

Figure 4A:
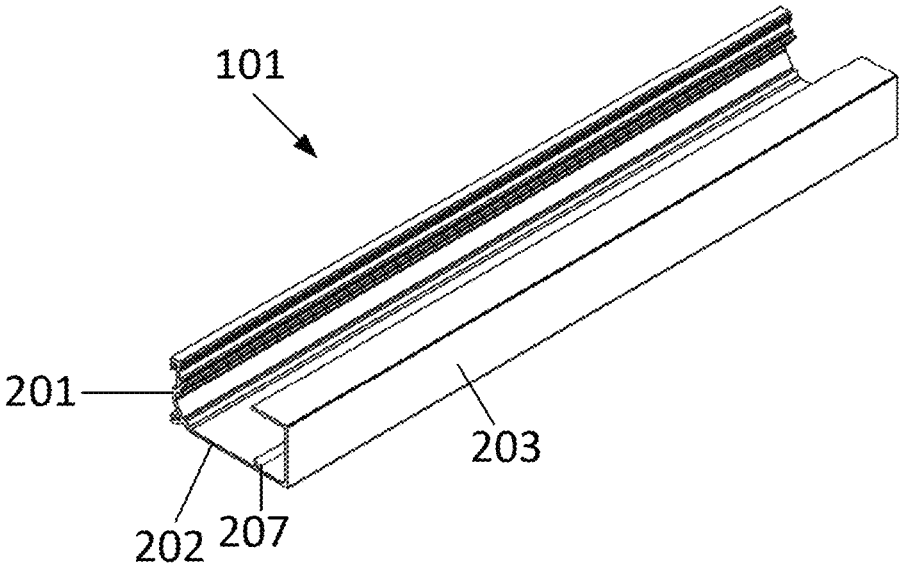
FIGS. 4A-4G show views of a square edge mud-in cove extrusion in accordance with embodiments of the disclosed technology.
Figure 4B:
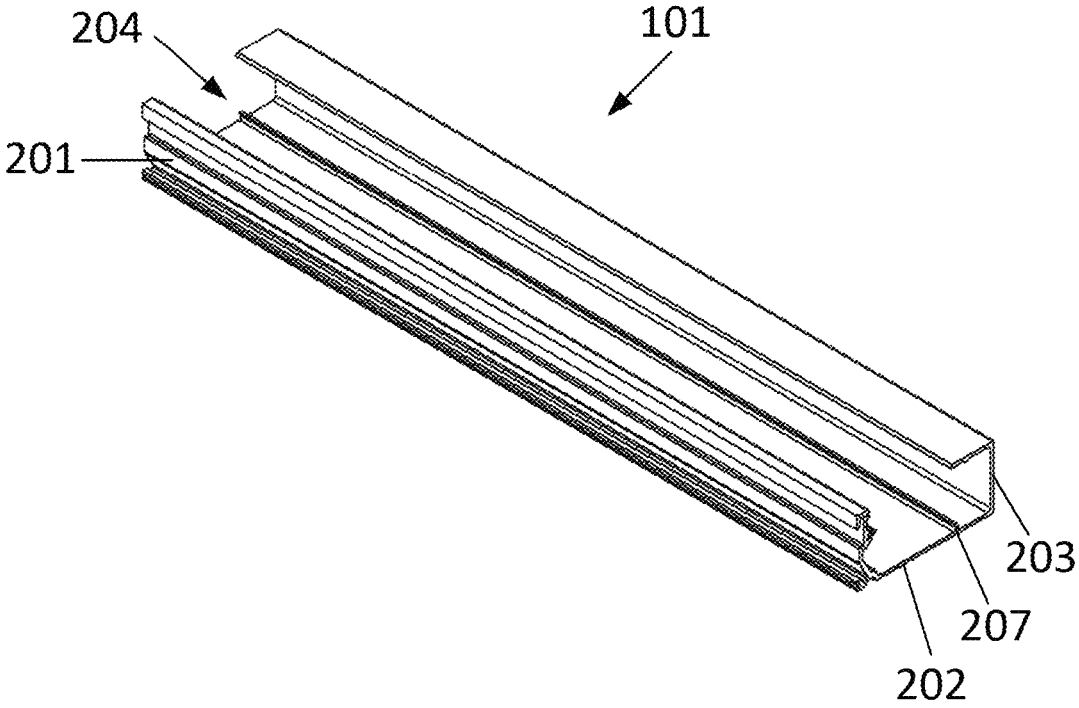
Figure 4C:
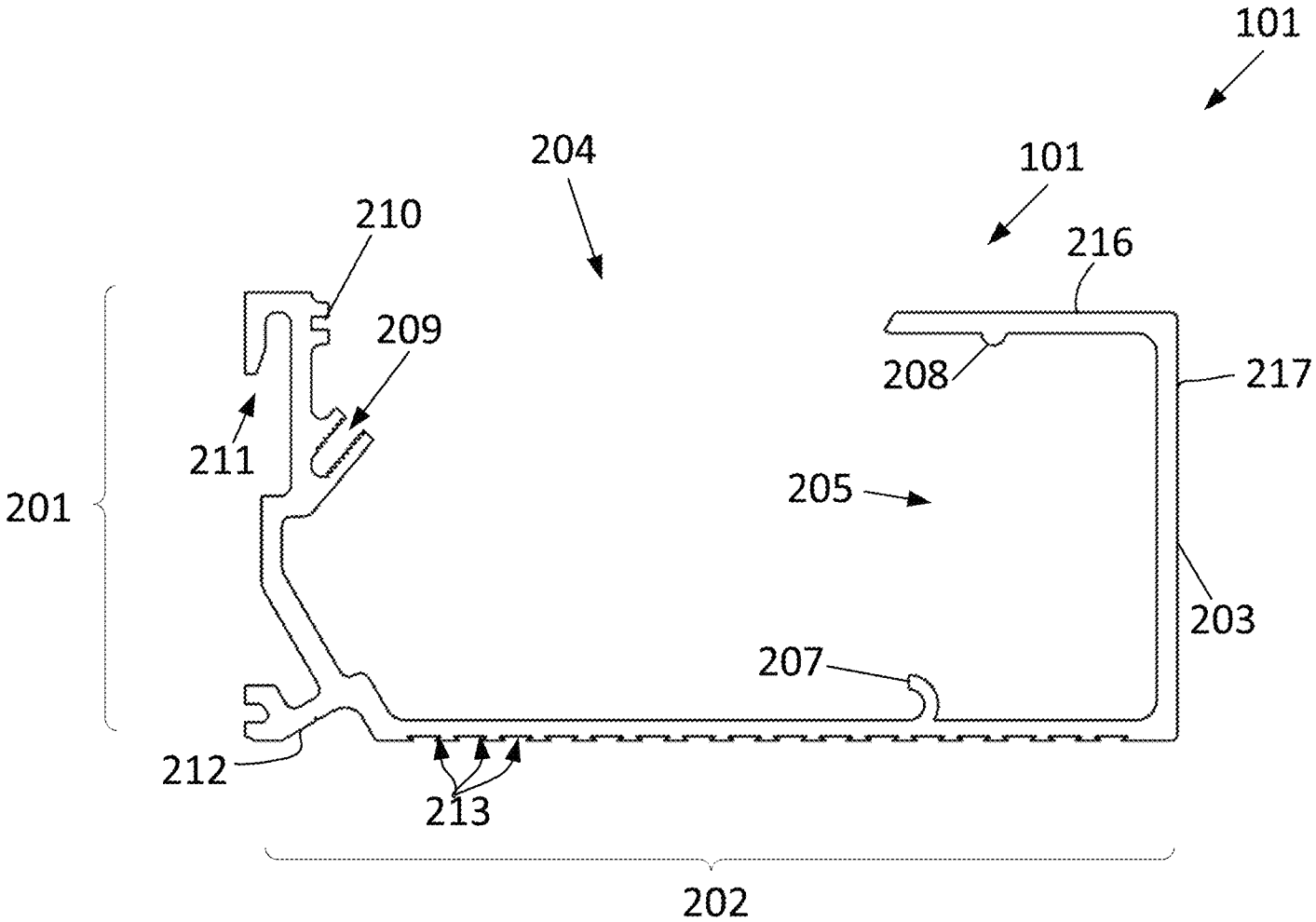
Figure 4D:
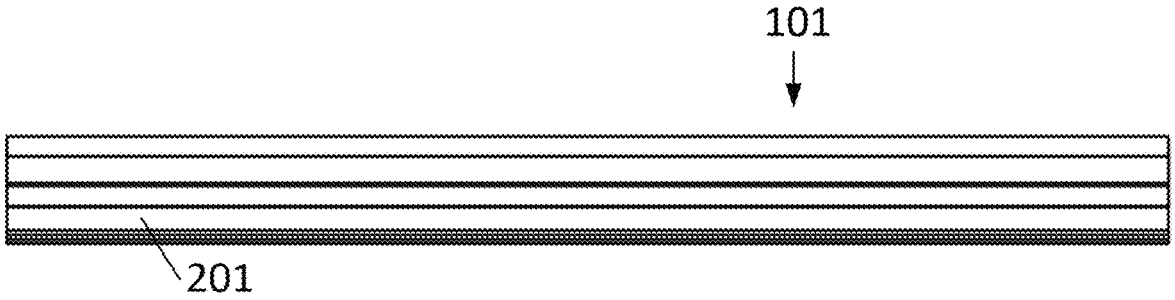
Figure 4E:
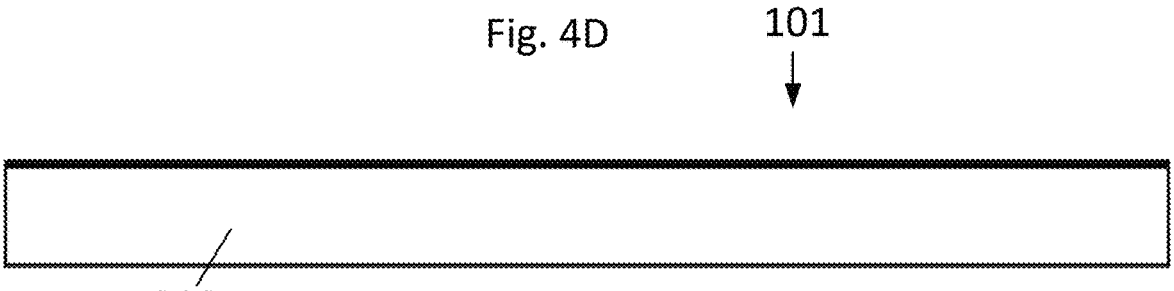
Figure 4F:
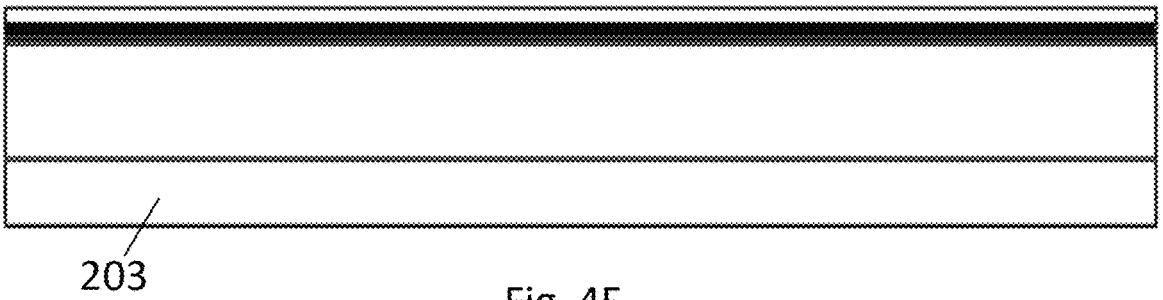
Figure 4G:
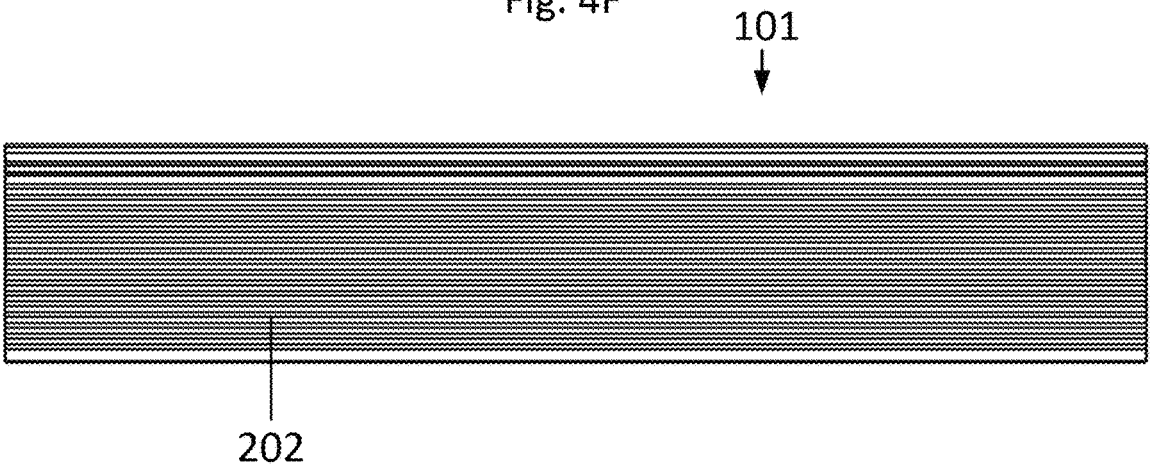

FIGS. 4D, 4E, 4F and 4G, show rear, front, top, and bottom views, respectively, of the cove extrusion shown in FIGS. 4A, 4B and 4C.

Figure 5A:
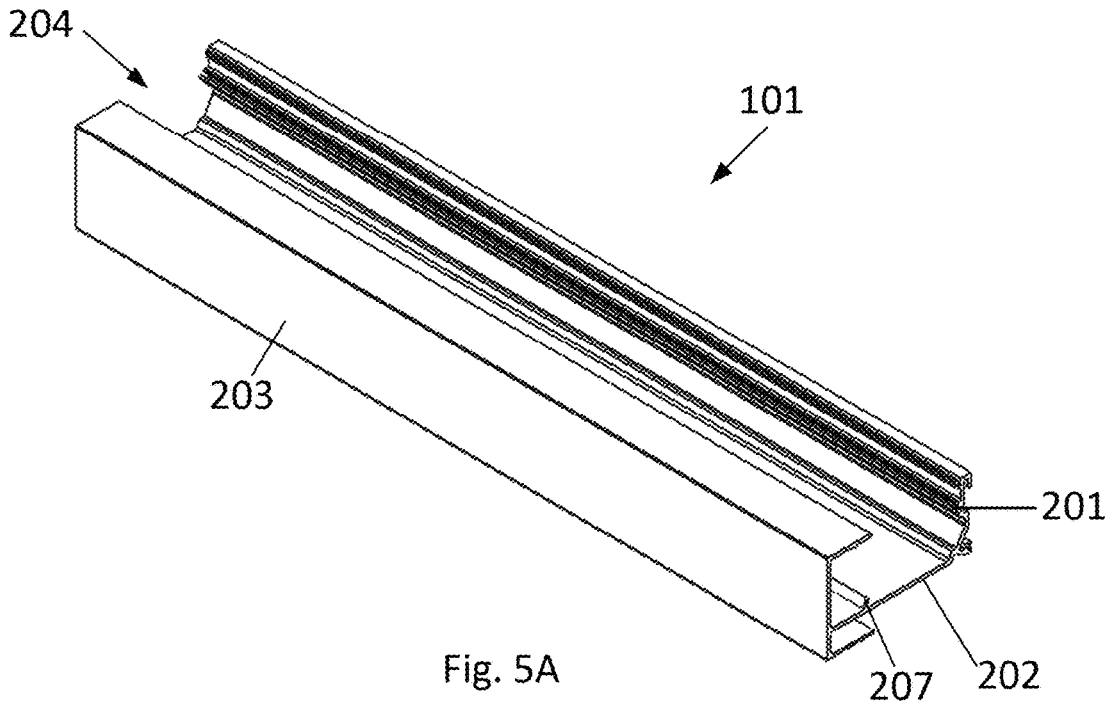
FIGS. 5A-5G show views of a square edge drywall cove extrusion in accordance with embodiments of the disclosed technology.
Figure 5B:
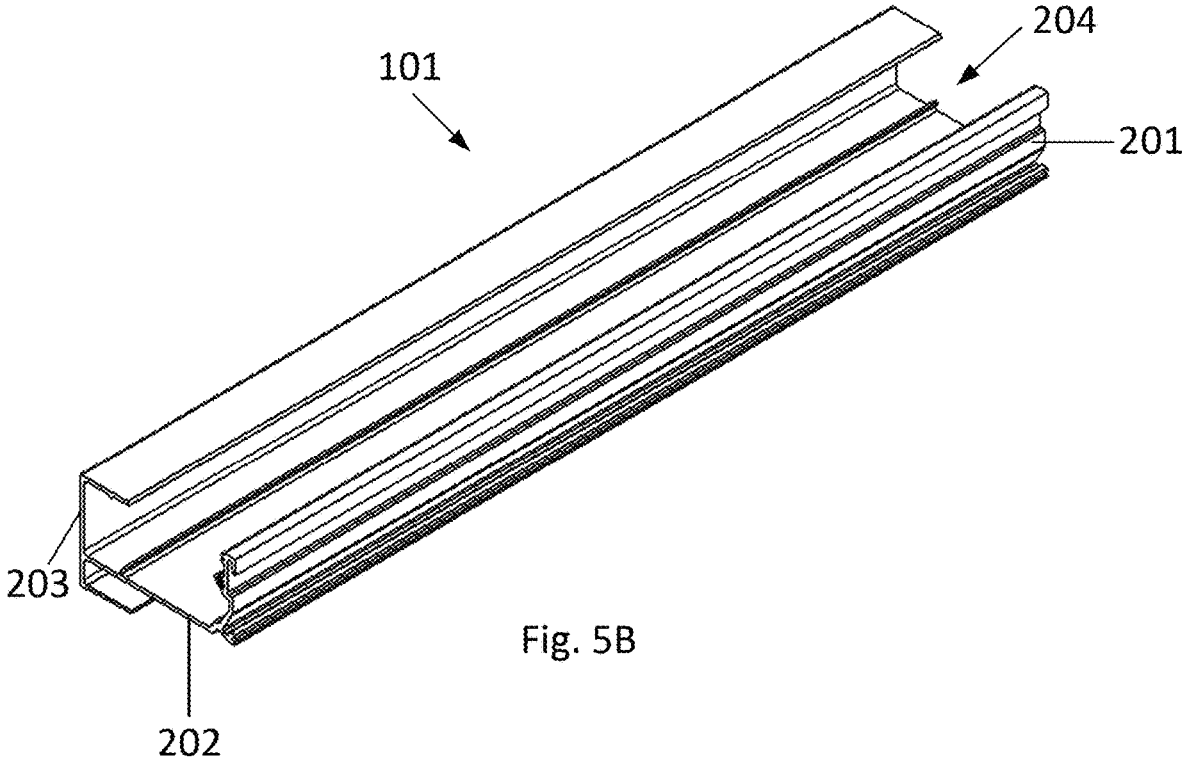
Figure 5C:
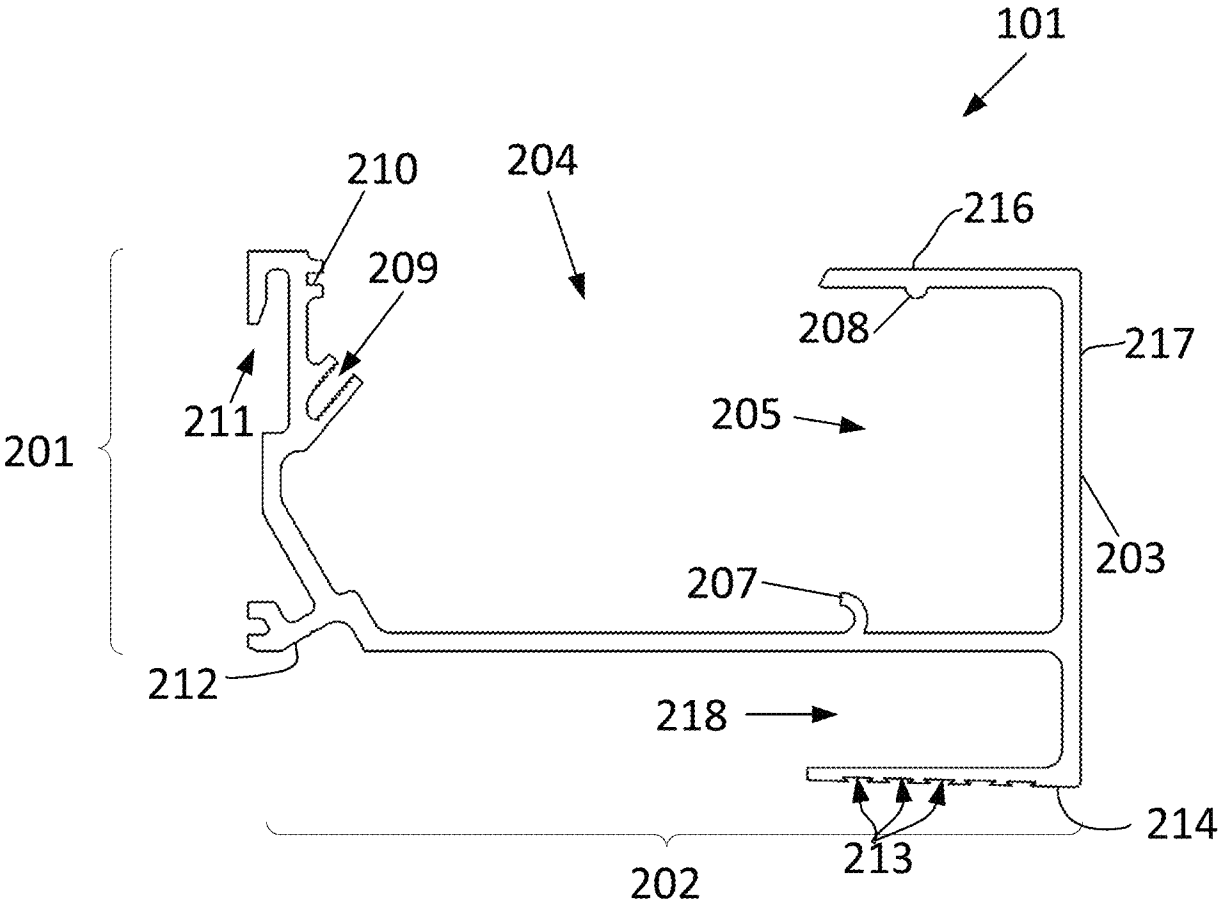
Figure 5D:
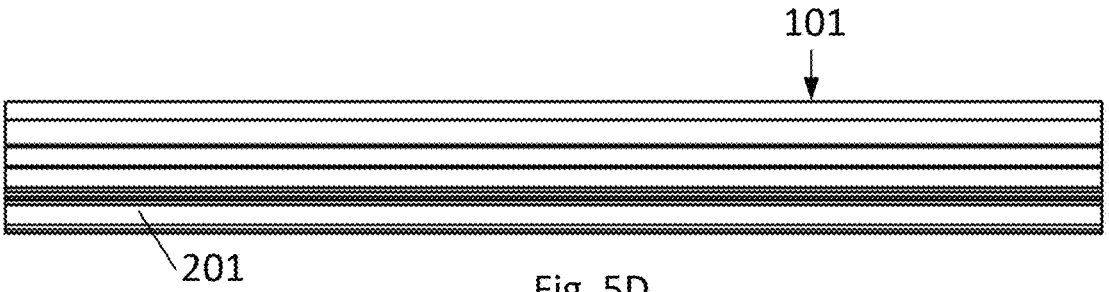
Figure 5E:
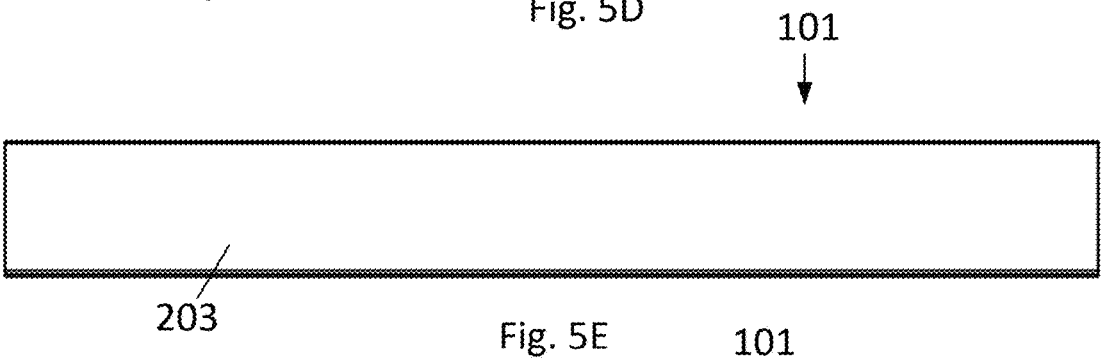
Figure 5F:
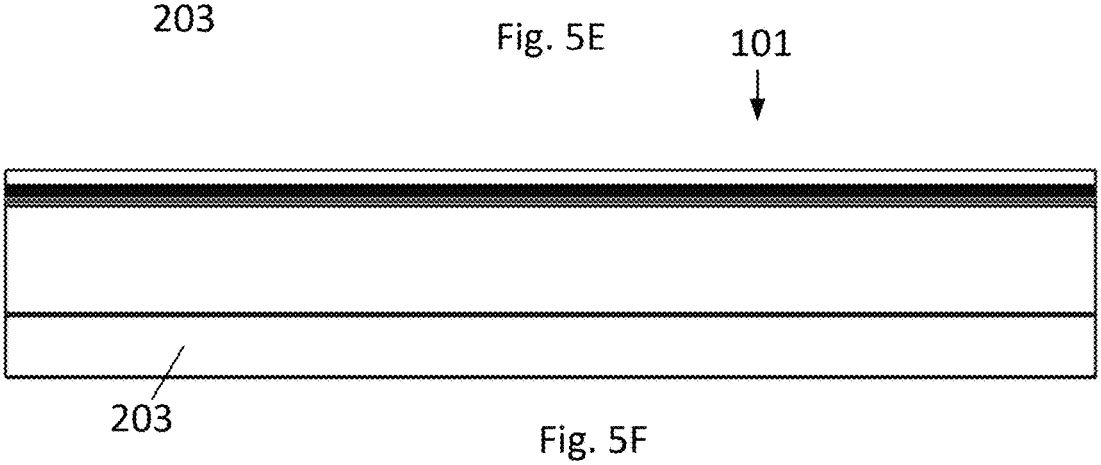
Figure 5G:
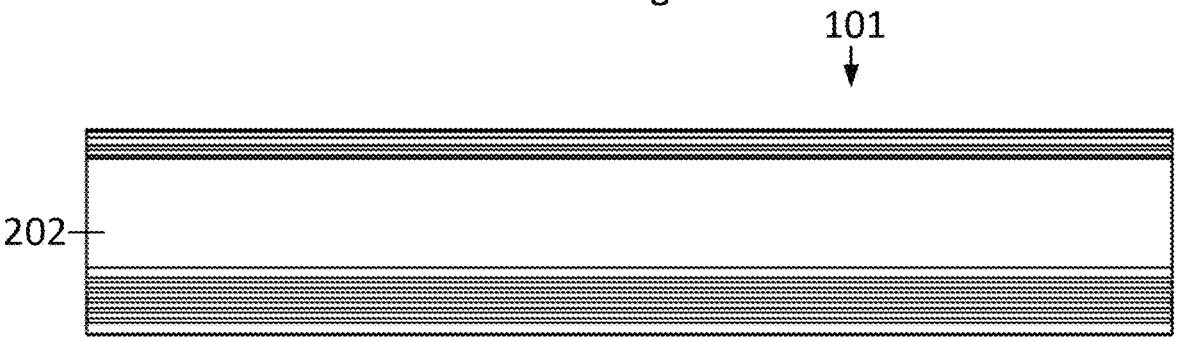

FIGS. 5A-5G show an embodiment of a cove extrusion with a knife edge and a cavity to receive a strip of wallboard sharing features of the cove extrusions shown in FIGS. 2A-2G and 3A-3G. As shown in FIG. 5C, the profile of the cove extrusion includes a front wall 203 extending below the bottom wall 202 and further comprises a front bottom wall 214. The front bottom wall 214, front wall 203, and bottom wall 202 define a wallboard channel 218 to retain a strip of wallboard. The wallboard may be placed within the wallboard channel 218 prior to hanging the cove extrusion to a mounting bracket attached to a building wall. FIGS. 5D, 5E, 5F and 5G, show rear, front, top, and bottom views, respectively, of the cove extrusion shown in FIGS. 5A, 5B and 5C.

Mounting Bracket

FIGS. 6A-6D show an embodiment of a mounting bracket 103. The mounting bracket 103 comprises a wall facing side 601 and an extrusion facing side 602. The mounting bracket 103 is attached to a building wall with the wall facing side contacting the building wall, and the extrusion facing side contacting the cove extrusion. The mounting bracket 103 includes a central portion 603, an upper mounting portion 604, and a lower mounting portion 605. The upper mounting portion 604 is parallel to and offset from the central portion 603, so that when the mounting bracket 103 is attached to a building wall with the wall facing side 601 of the central portion 603 contacting the building wall, an upper mounting channel 606 is defined between the wall and the upper mounting portion.

The lower mounting portion 605 is coupled to and curves away from the central portion 603 so that a lower mounting channel 607 is defined between the lower mounting portion 605 and the central portion 603 on the extrusion facing side of the mounting bracket. The curved portion includes one or more holes 608 to receive threaded fasteners to be treaded into the clamping surface of the cove extrusion.

Figure 6A:
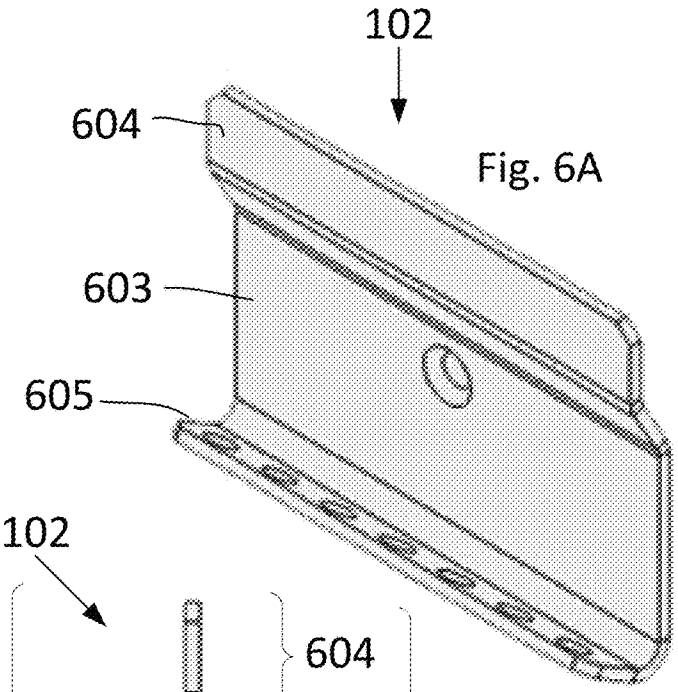
FIGS. 6A-6D show views of a mounting bracket in accordance with embodiments of the disclosed technology.
Figure 6D:
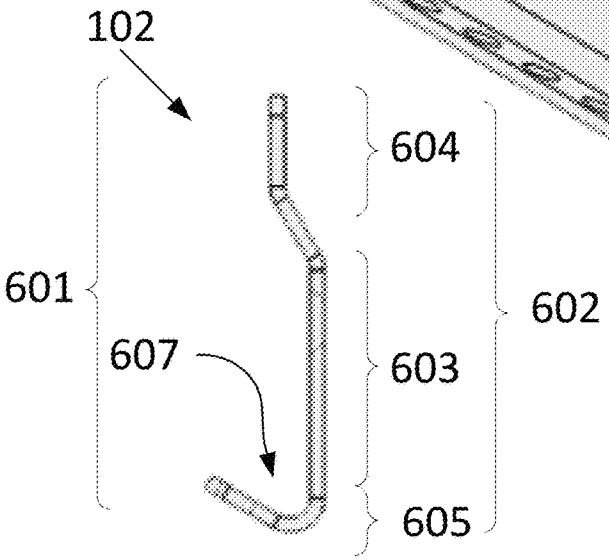
Figure 6B:
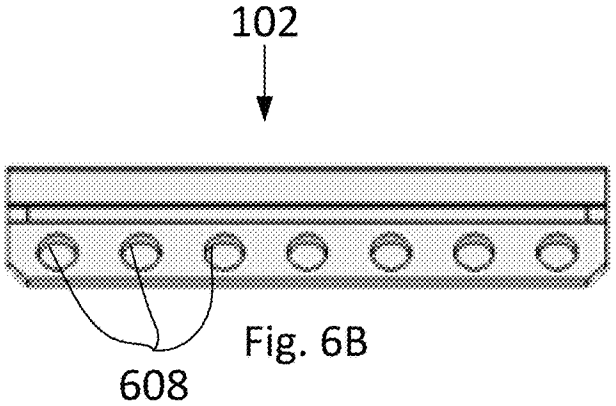
Figure 6C:
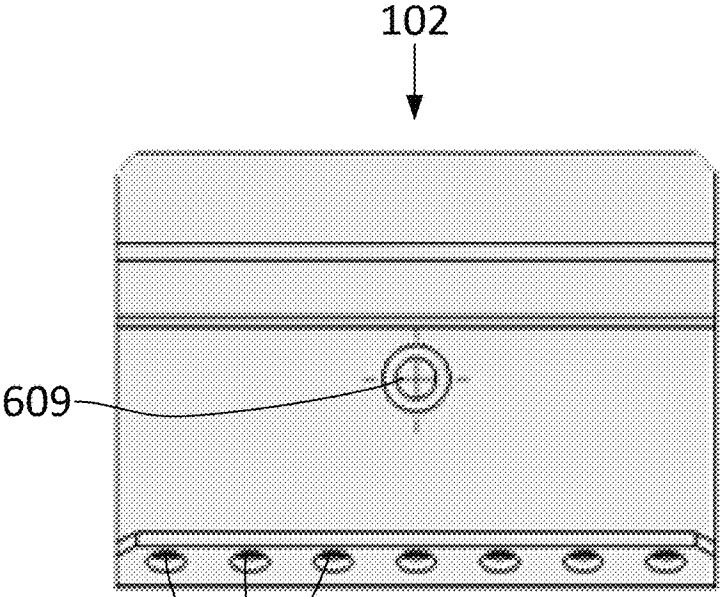

The mounting bracket may be formed of stamped sheet metal. The mounting bracket is sized to be small relative to the cove extrusion, and may be between 1 inch and 5 inches wide in the horizontal direction when mounted to a building wall, whereas the cove extrusions may be 1 to 8 feet long, or more, in the horizontal direction. The wall mounting bracket may be attached to a building wall with a fastener extending through the wall mounting bracket. The wall mounting bracket may include a slot, hole, notch, or groove configured for the fastener to attach the mounting bracket to a building wall. For example, a mounting bracket may include a central hole 609 in the wall contacting portion, as shown in FIG. 6C. The size and weight of the mounting brackets allow for a single installer to mount a plurality of mounting brackets along a level line on a building wall. The cove extrusion may then be hung on the mounting brackets, thus eliminating a need for an installer to hold an extrusion in place while fasteners are used to secure the cove extrusion.

Method of Attaching Cove Extrusions to a Building Wall

Figure 7A:
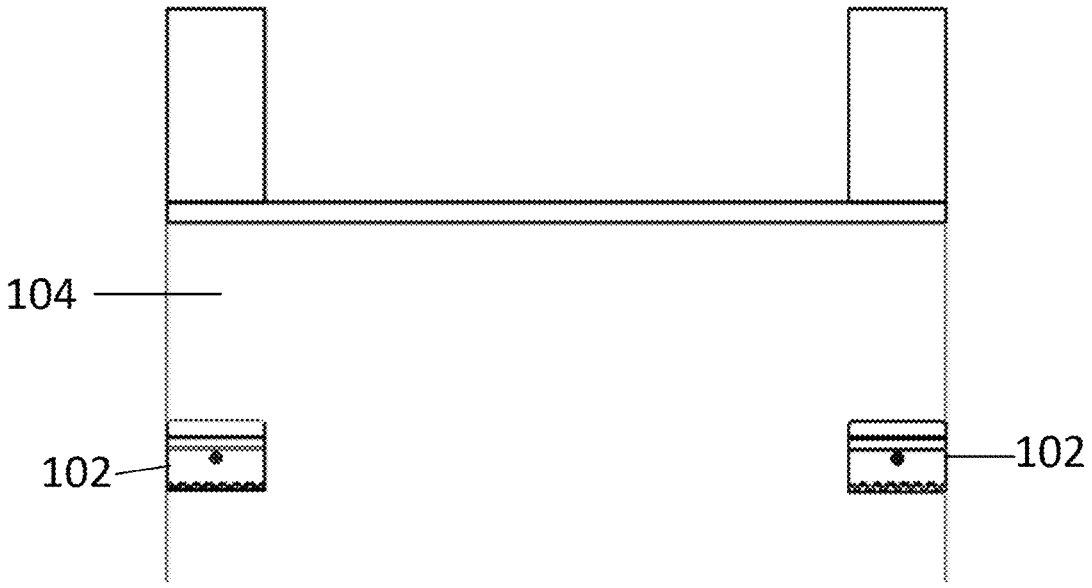
FIGS. 7A-7G show views of steps for attaching cove extrusion to a building wall with mounting bracket in accordance with embodiments of the disclosed technology.
Figure 7B:
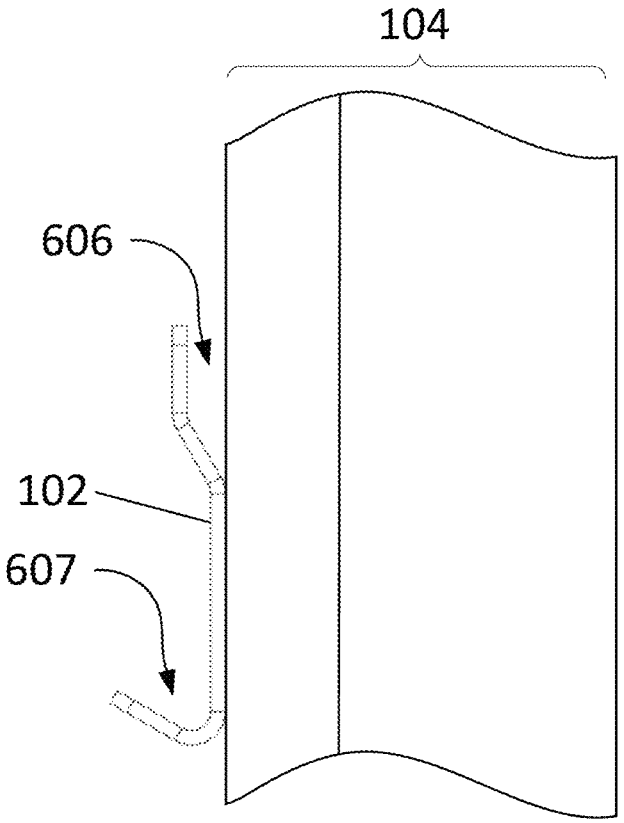

The mounting brackets 102 may be attached to the studs of a building wall 104, as shown for example in FIGS. 7A and 7B. Alternatively, mounting brackets may be attached to wallboard with hangers intended to secure to wallboard, e.g. drywall screws. The mounting brackets may be attached to the building wall at the same horizontal level using a laser level. In embodiments, two or more mounting brackets may be used to attach one cove extrusion to a wall. In embodiments, a single mounting bracket may be received in the mounting channel of two adjacent cove extrusions. In embodiments, mounting brackets of different widths may be used to accommodate the position of the studs relative to the interfaces of adjacent cove extrusions.

Figure 7C:
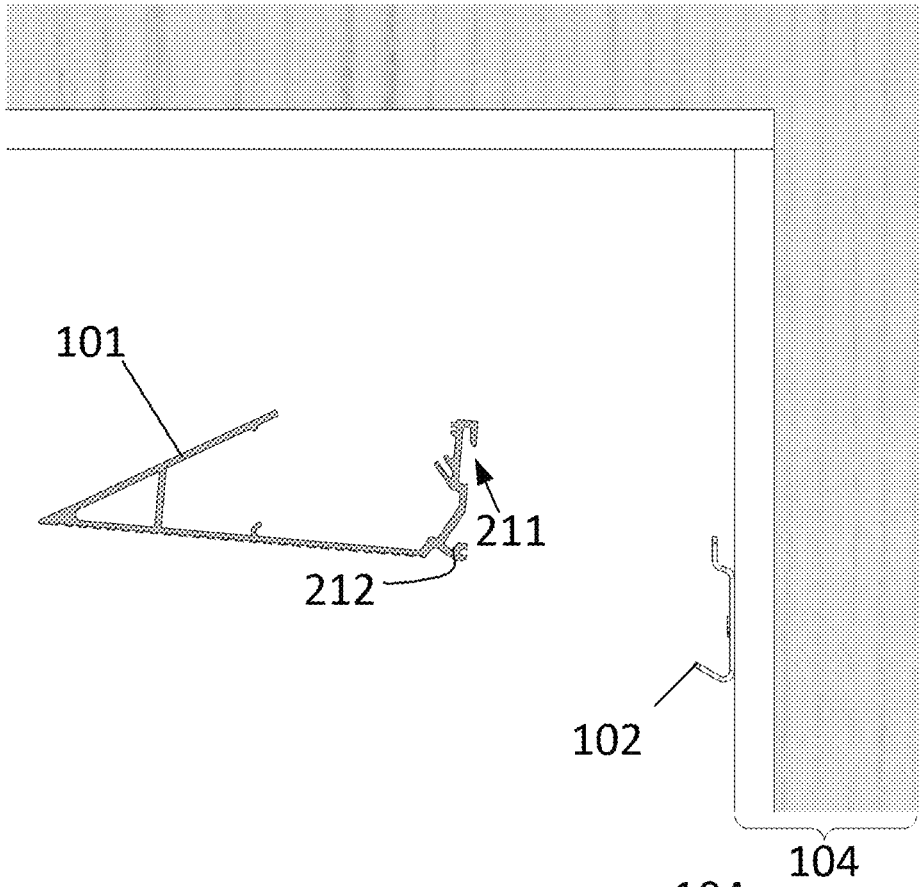
Figure 7D:
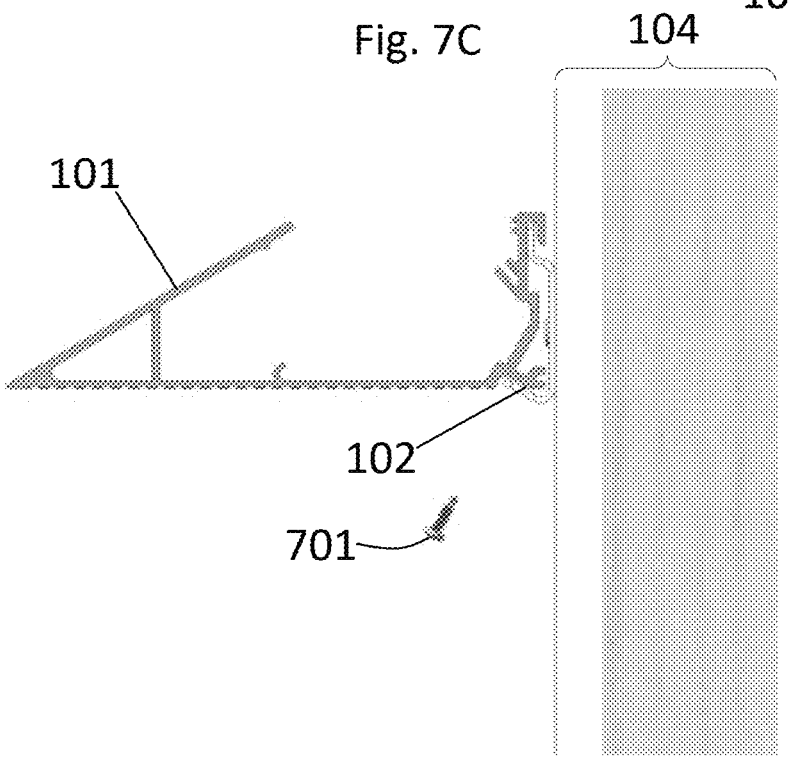

FIG. 7B shows a profile of a mounting bracket 102 attached to a building wall 104 to define the mounting channel between the upper mounting portion of the mounting bracket and the building wall. To connect a cove extrusion to a mounting bracket, a cove extrusion may be held horizontally and moved toward the mounting brackets 102 from above as shown in FIG. 7C. The cove extrusion is then lowered onto the mounting brackets 102 so that the upper mounting portion is received in the bracket channel and the clamping surface is received within the lower mounting channel, as shown in FIG. 7D. In this position unless acted upon by an outside force the cove extrusion will remain suspended from the mounting brackets 102 without any use of fasteners between the mounting bracket and the cover extrusions or between the cove extrusion and the building wall, thus allowing an installer to perform other installation tasks without holding the cove extrusion in place.

Figure 7E:
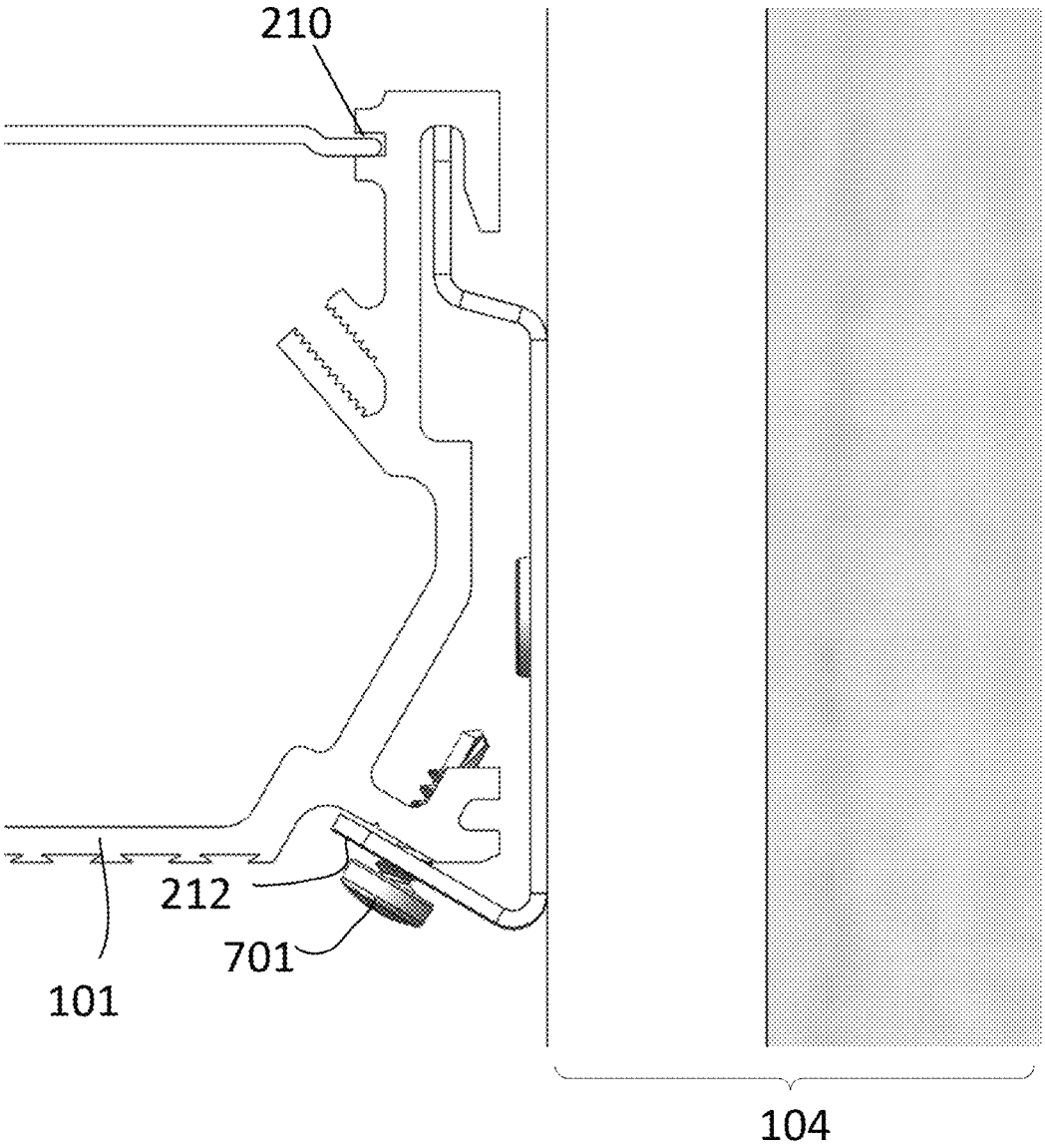
Figure 7F:
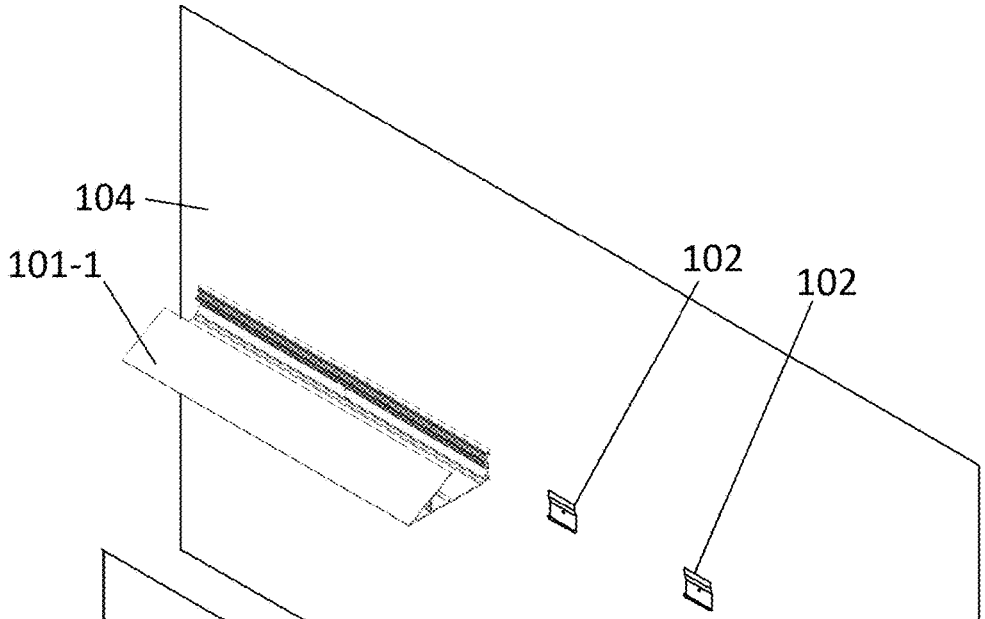
Figure 7G:
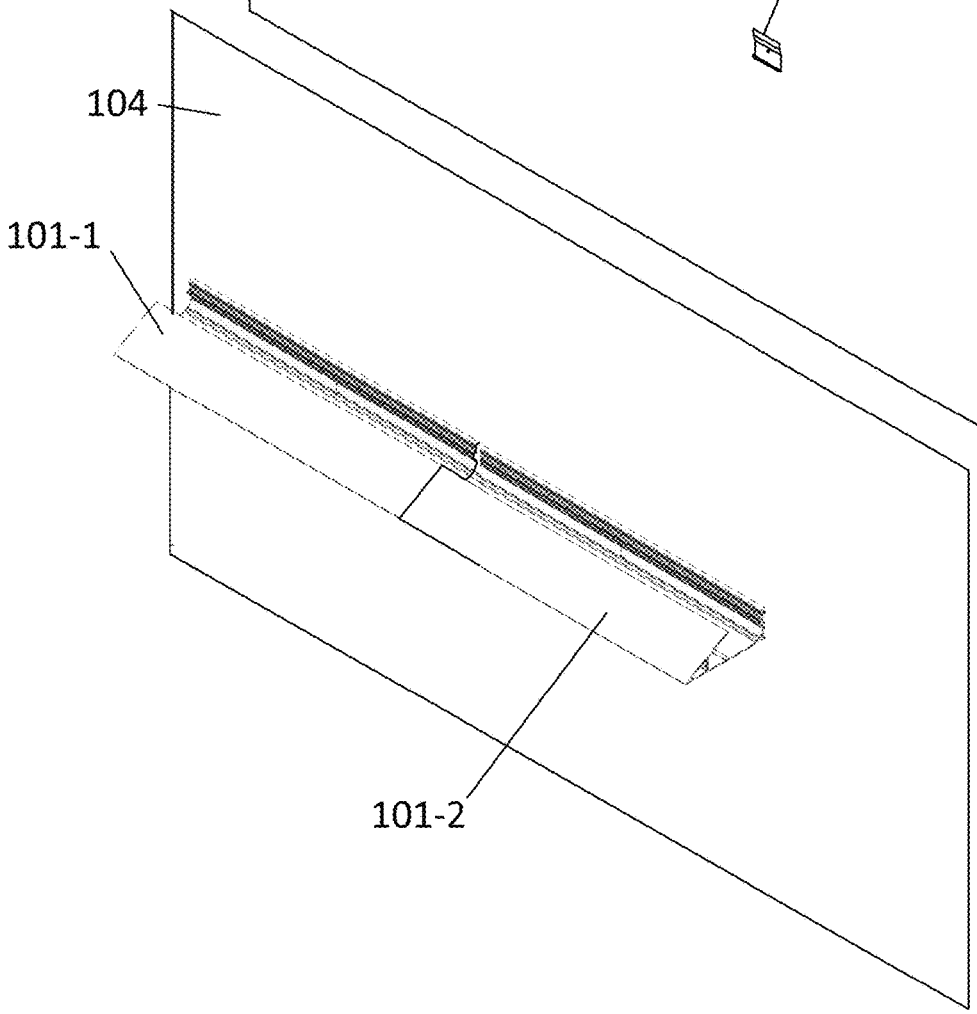
Figure 8A:
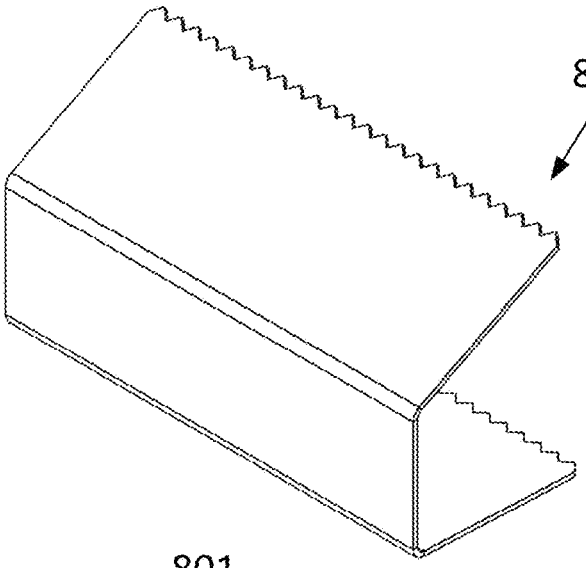
FIGS. 8A-8D show views of a spring clip in accordance with embodiments of the disclosed technology.
Figure 8B:
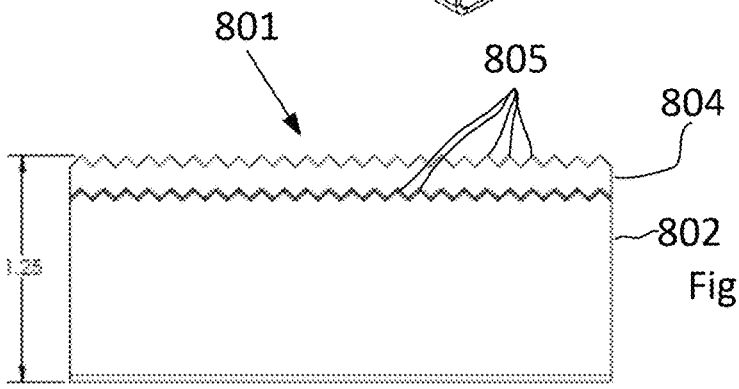
Figure 8C:
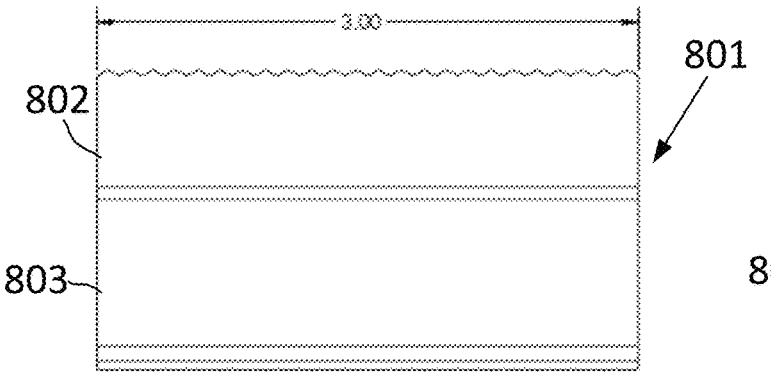
Figure 8D:
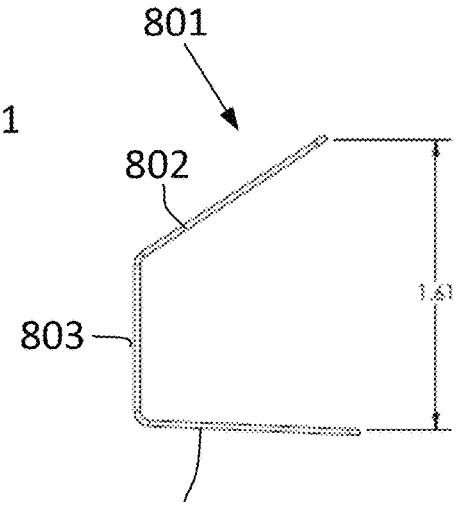

To secure the cove extrusion to the mounting brackets 102, threaded fasteners 701 may be treaded into one of the one or more holes 608 on each mounting bracket 102 in order to thread into the clamping surface and pull the clamping surface against the lower mounting portion of the mounting bracket 102, as shown in FIG. 7E. The threaded faster 701 prevents upward movement of the cove extrusion 101 and therefore the upper mounting portion of the mounting bracket is prevented from being removed from the mounting channel of the cove extrusion. Securing the cove extrusion to the mounting bracket may be performed before or after an adjacent cove extrusion is hung from and/or secured to adjacent mounting brackets. For example, as shown in FIG. 7F, a first cove extrusion 101-1 is hung from a pair of mounting brackets 102 adjacent to another pair of mounting brackets. Subsequently a second cove extrusion 101-2 may be hung next to the first cove extrusion 101-1, as shown in FIG. 7G. In embodiments, a cove extrusion is first attached to adjacent cove extrusions with a spring clip 801 in order to have proper alignment with the adjacent cove extrusions prior to be secured to the mounting bracket with fasteners.

Spring Clip

FIGS. 8A-8D show a spring clip 801 that may be used to connect adjacent cove extrusions. The spring clip 801 is generally U-shaped with a lower leg 804, a middle section 803, and an upper leg 802. The spring clip is sized and shaped to be received into the clip channel 205 portion of the cove channel 204 so that an end of the upper leg 802 is received against the second retaining flange 208 and the lower leg 804 is received against first retaining flange 207. The ends the upper leg 802 and the lower leg 804 may have teeth 805 to engage the surfaces of the cove extrusion 101 in order to ground adjacent cove extrusions to each other.

Figure 9A:
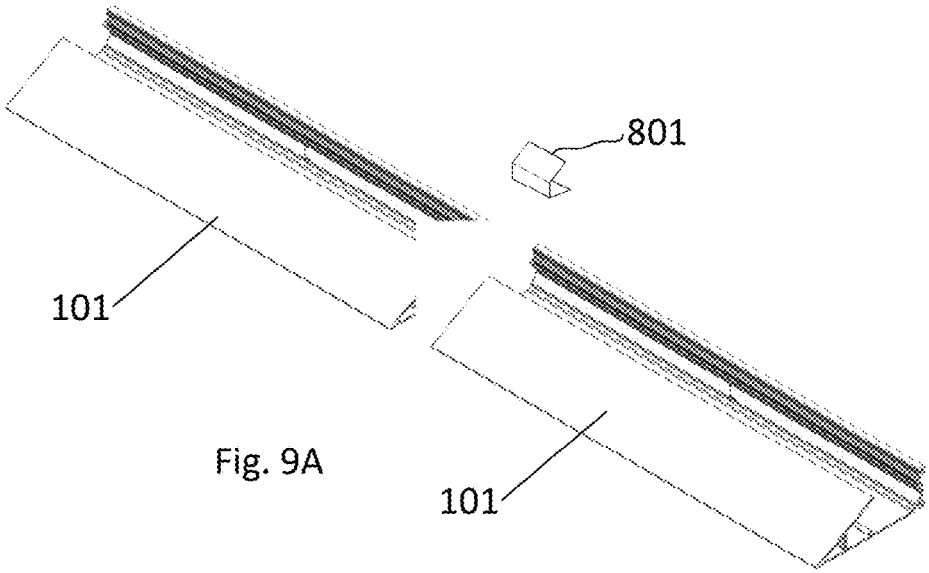
FIGS. 9A-9G show views of steps of attaching a spring clip to adjacent cove extrusions in accordance with embodiments of the disclosed technology.
Figure 9B:
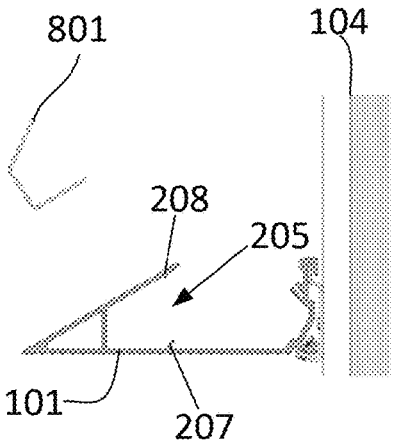
Figure 9C:
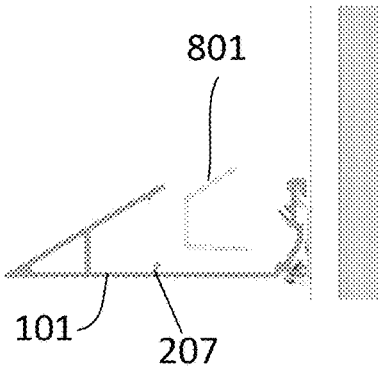
Figure 9D:
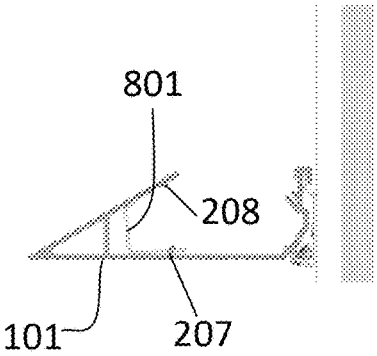
Figure 9E:
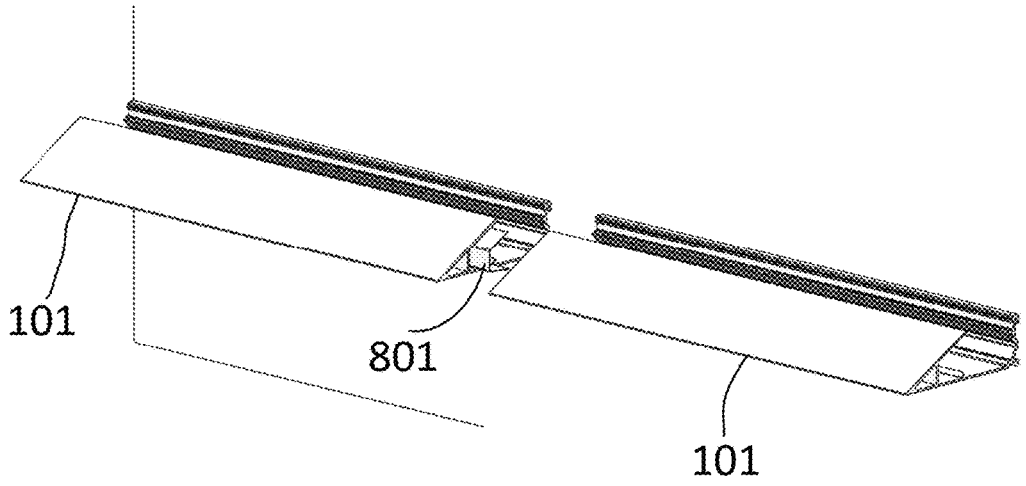
Figure 9F:
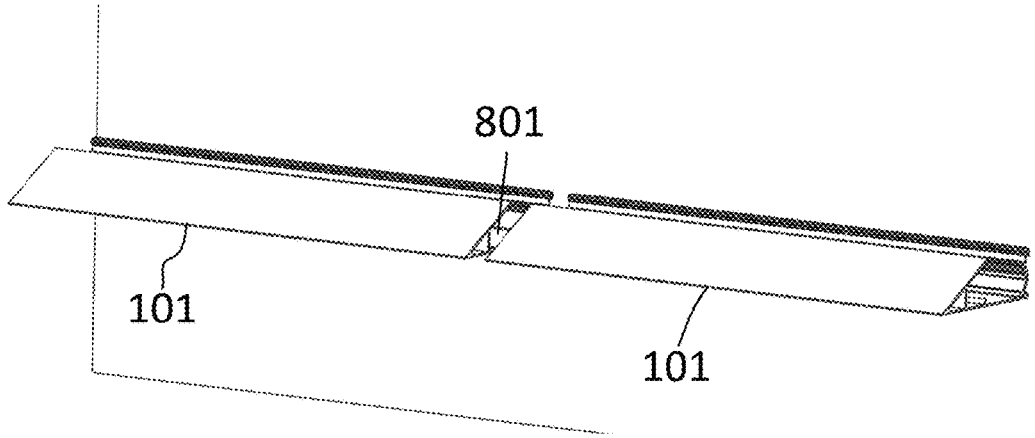
Figure 9G:
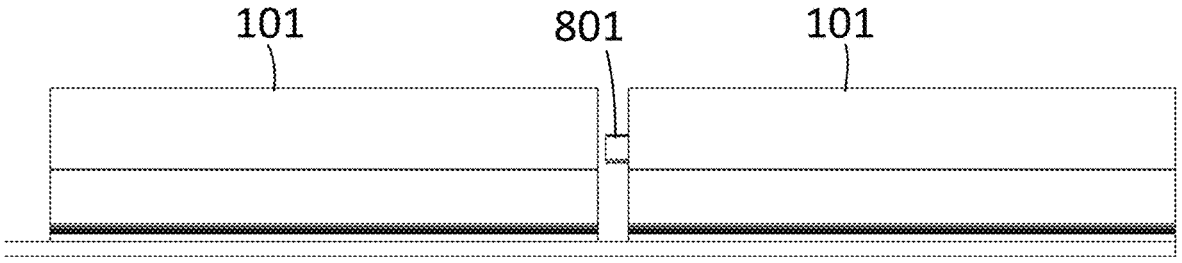

To install the spring clip to adjacent cove extrusions, the spring clip 801 is oriented so that the ends of the upper leg 802 and lower leg 804 face the building wall 104, as shown in FIG. 9B. The spring clip 801 is positioned in the cove channel 104 of two adjacent cove extrusions, and the middle section 803 is pressed in a direction away from the rear wall 201 toward the front wall 203, so that the upper and lower legs are compressed toward each other and apply a spring force to hold the spring clip in place against the first and second retaining flanges 207 and 208 of the cove channel, as shown in FIGS. 9B-9D. The legs passing over and past the first and second retaining flanges produces an audible clicking noise to provide the installer a non-visual indication that the spring clip is properly installed. FIGS. 9E-9G show the position of the installed spring clip 801 in a cove extrusions 101, with the adjacent cove extrusion 101 translated horizontally in order to not obscure the spring clip 801. The spring clip may provide grounding of adjacent cove extrusions, as well as provide alignment between adjacent cove extrusions so that adjacent outer surfaces of the walls of the cove extrusions remain coplanar and the corners defined by the interface of the bottom wall and front walls extend in a smooth continuous line so that when a finish is applied the interface between adjacent cove extrusions is not noticeable by an observer. Further, the spring clips may prevent light from escaping through the interface of adjacent cove extrusions.

Power Box and Luminaire Attachment

Figure 10A:
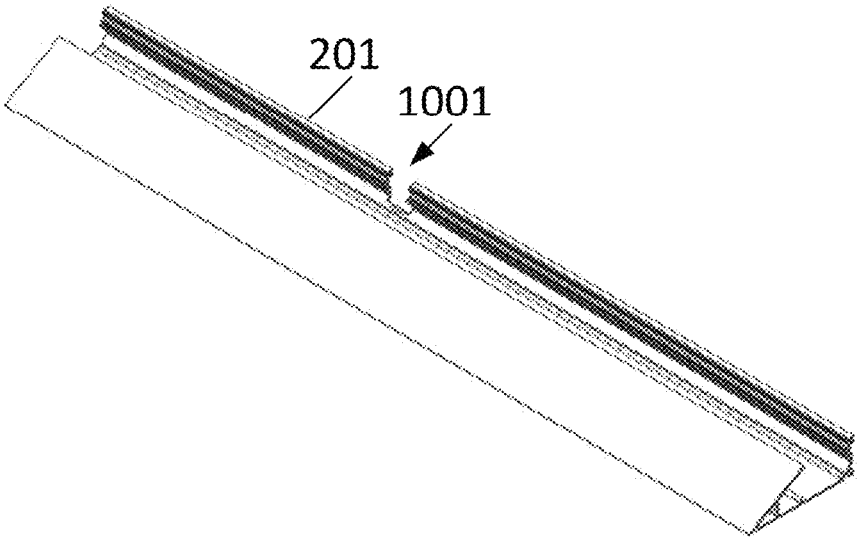
FIGS. 10A-10C show views of steps a cove extrusion with a notch in accordance with embodiments of the disclosed technology.
Figure 10B:
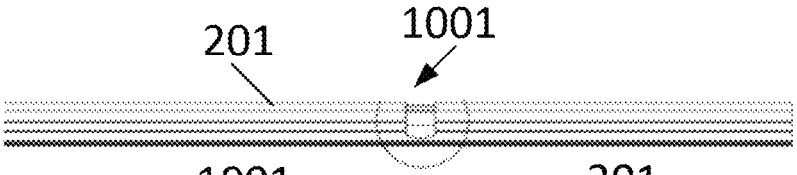
Figure 10C:
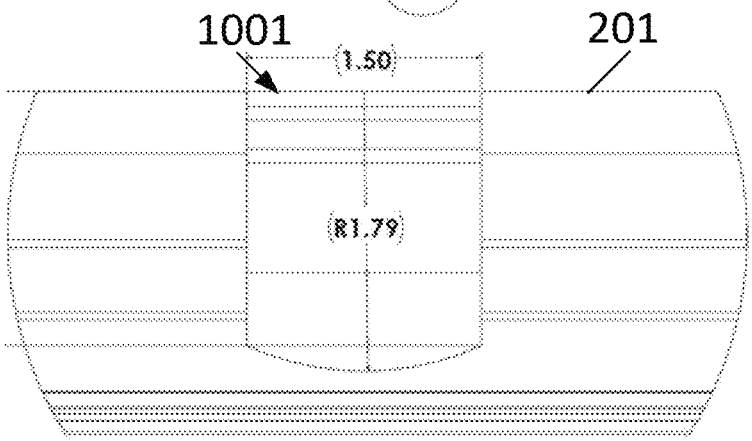

In embodiments, a power box is positioned in the cove channel of one or more adjacent cove extrusions in order to distribute power to luminaires positioned in the cove channels of the one or more adjacent cove extrusions. The power box may be attached to and receive power from a conduit extending within the building wall. In order for the system to have a uniform appearance the conduit may be received through the rear wall 201 of a cove extrusion 101, so that the building wall on either side of the cove extrusion is free from power delivery elements. In embodiments a notch 1001 may be cut out of a rear wall 201 in order for a conduit to be received into the cove channel, for example as shown in FIGS. 10A-10C. The notch may extend from a top edge of the rear wall through the mounting channel.

Figure 11A:
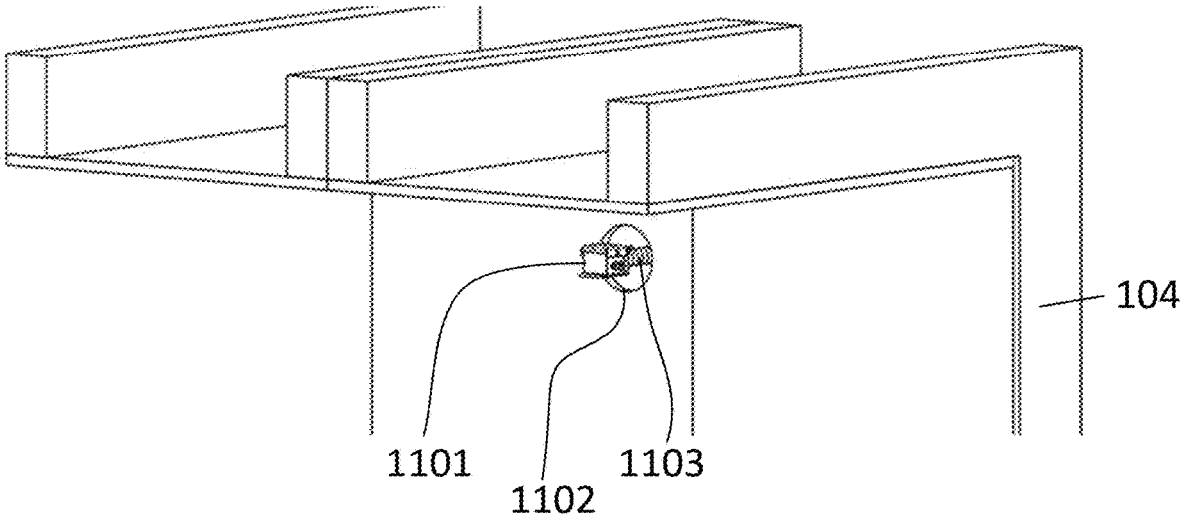
FIGS. 11A and 11B show views of steps of positioning a power box on a building wall in accordance with embodiments of the disclosed technology.
Figure 11B:
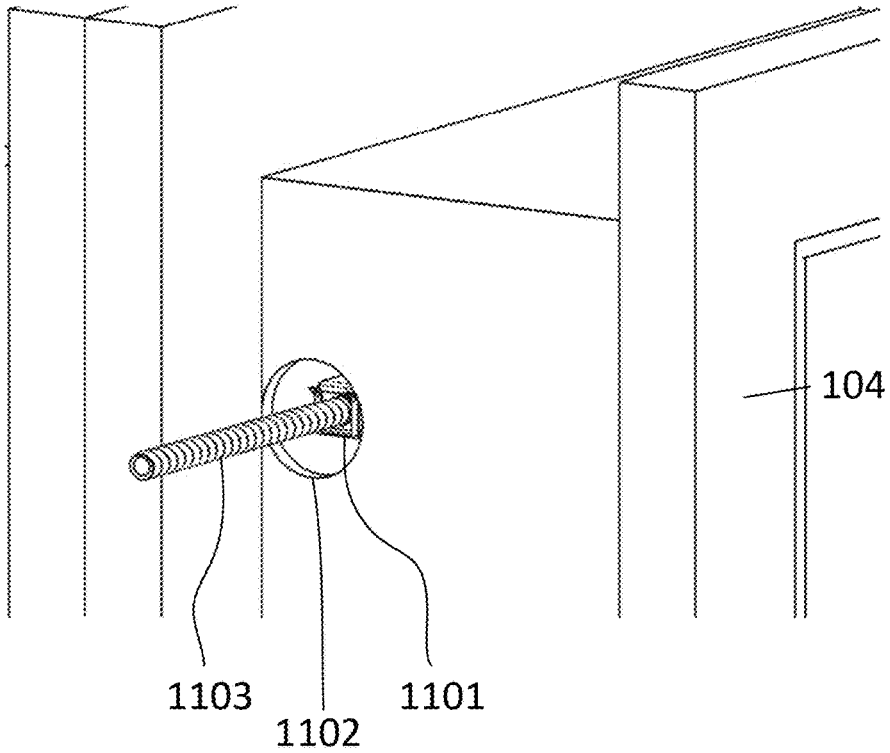

To attach a power box 1101 to a cove extrusion 101 the power box 1101 may first be connected to a power source within a building wall 104, and a hole 1102 may be cut in the building wall 104 in a position that will be covered by the installed cove extrusions, but not covered by a mounting bracket, as shown for example in FIG. 11A. FIG. 11B shows a rear view of the building wall 104 comprising studs and drywall, with the power box 1101 and conduit 1103 extending through the hole 1102.

Figure 12A:
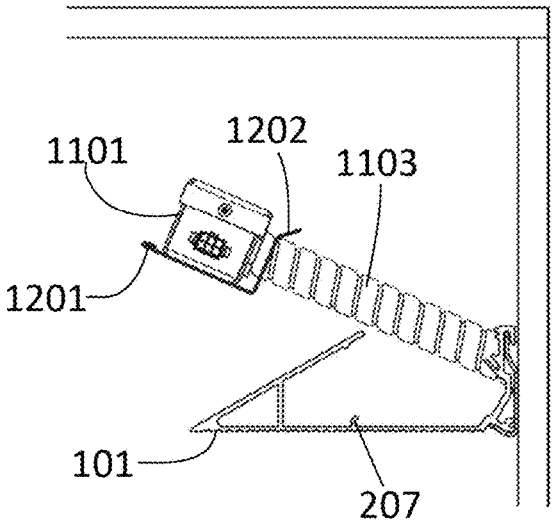
FIGS. 12A-12F show views of steps of attaching a power box within a cove channel of a cove extrusion.
Figure 12B:
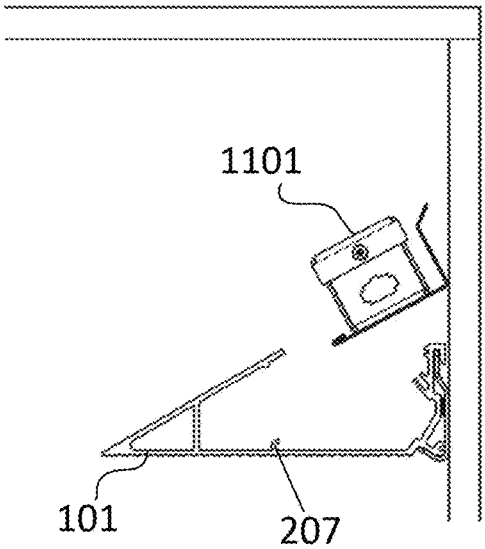
Figure 12C:
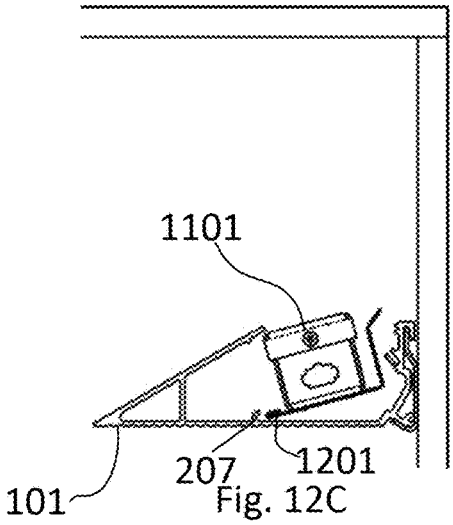
Figure 12D:
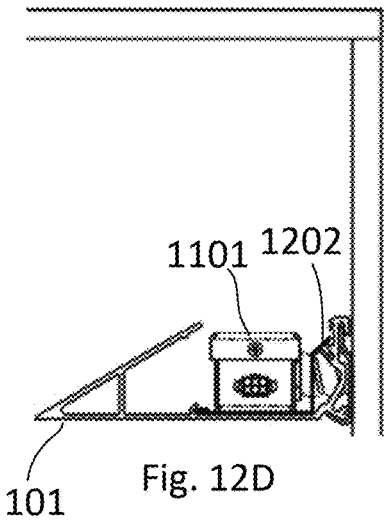
Figure 12E:
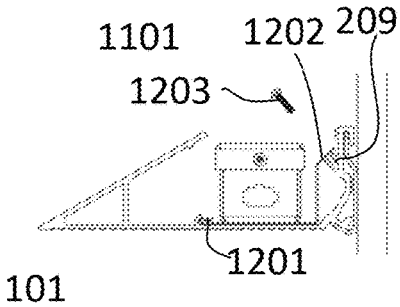
Figure 12F:
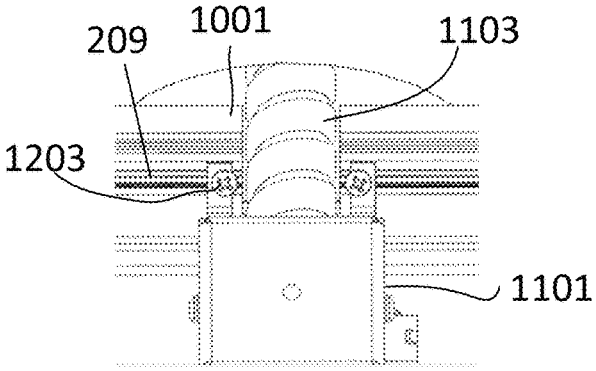

A cove extrusion 101 with a notch 1001, as shown in FIG. 10A may be hung with the notch positioned over the power box hole 1102 so that the conduit 1103 is positioned within the notch 1001, as shown for example in FIG. 12A. The power box 1101 may then be positioned so that a foot flange 1201 of the power box 1101 is received into the hinge channel defined by the first retaining flange 207 of the bottom wall of the cove extrusion, as shown for example in the sequence of in FIGS. 12B and 12C. The power box 1101 may then be rotated down so that a top flange 1202 of the power box 1101 is place against the fastener channel 209, as shown in FIG. 12D, and fasteners 1203 may be used to secure the power box to the fastener channel as shown in FIGS. 12E and 12*f*. For clarity purposes the conduit connected to the power box is omitted in FIGS. 12B-12E.

Figure 13A:
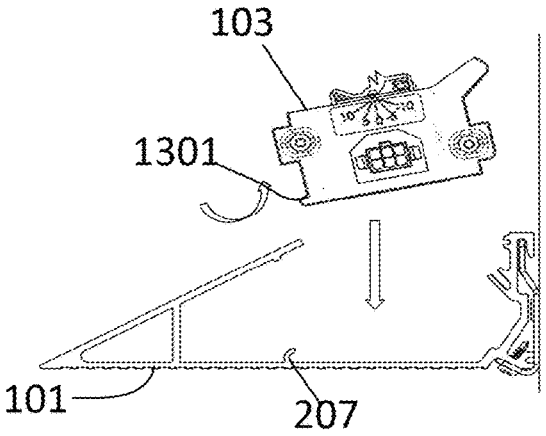
FIGS. 13A-13E show views of steps of attaching a luminaire within a cove channel of a cove extrusion.
Figure 13B:
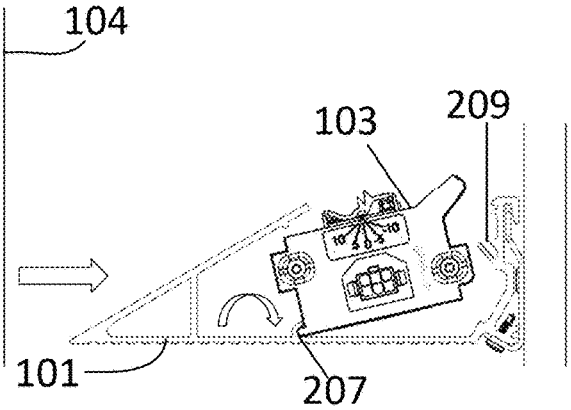
Figure 13C:
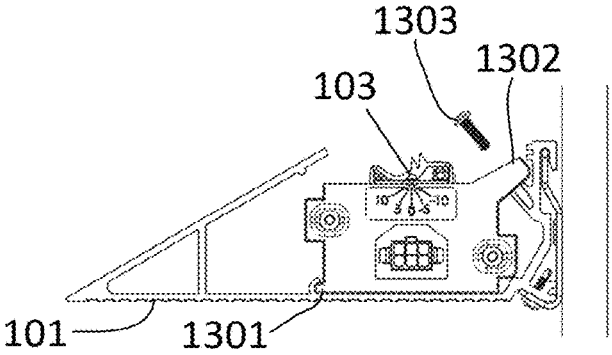
Figure 13D:
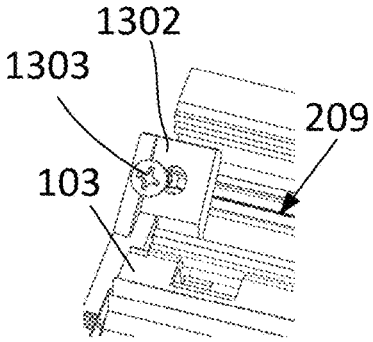
Figure 13E:
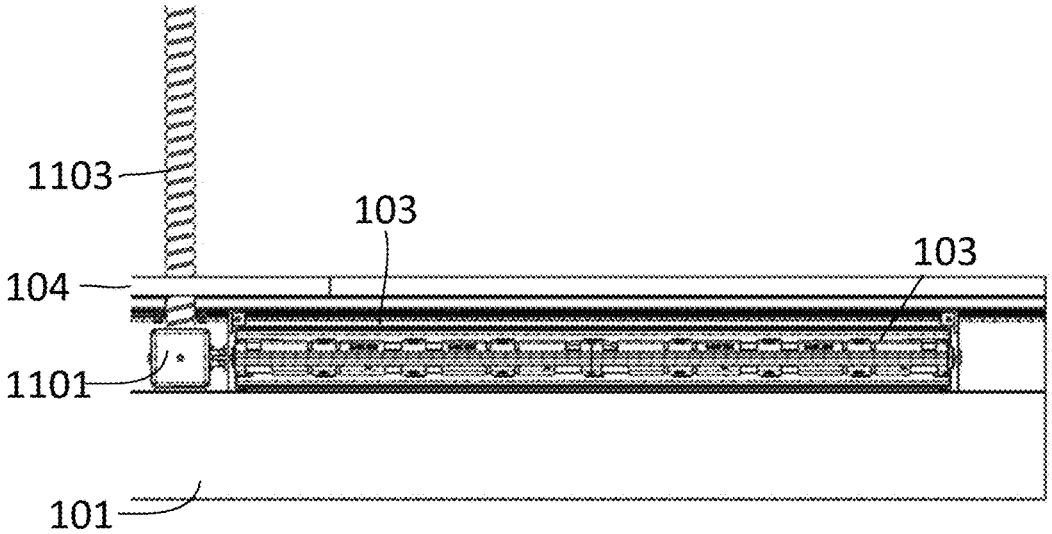

One or more luminaires 103 may be attached within the cove channel 104 in each cove extrusion 101 in a system 100 in a similar manner as a power box 1101. In embodiments, a luminaire 103 comprises a housing containing lighting elements and lighting drivers. The housing defines a foot flange 1301 along a bottom edge of the housing. As shown in FIG. 13A, a luminaire 103 may be lowered into a cove channel 204 with the foot flange 1301 facing away from the building wall 104. The foot flange may then be placed into the hinge channel defined by the first retaining flange 207 of the bottom wall 202, as shown for example in FIG. 13B. The luminaire 103 may then for rotated down so that a top flange 1302 of the luminaire is placed against the fastener channel 209, as shown in FIG. 13C, and fasteners 1303 may be used to secure the luminaire to the fastener channel 209 as shown in FIG. 13D. The luminaire 103 may be coupled to a power box 1101, as shown in FIG. 13E. Additional luminaires may be positioned in the cove extrusion or adjacent cove extrusions and be electrically coupled together to form a run of luminaires coupled to a single power box. In embodiments, the length of the luminaire may be generally the same length as a cove extrusion. In embodiments, the length of the luminaire may be less than the length of a cove extrusion so that a cove extrusion in a system contains a plurality of luminaires, or portions thereof.

Figure 14A:
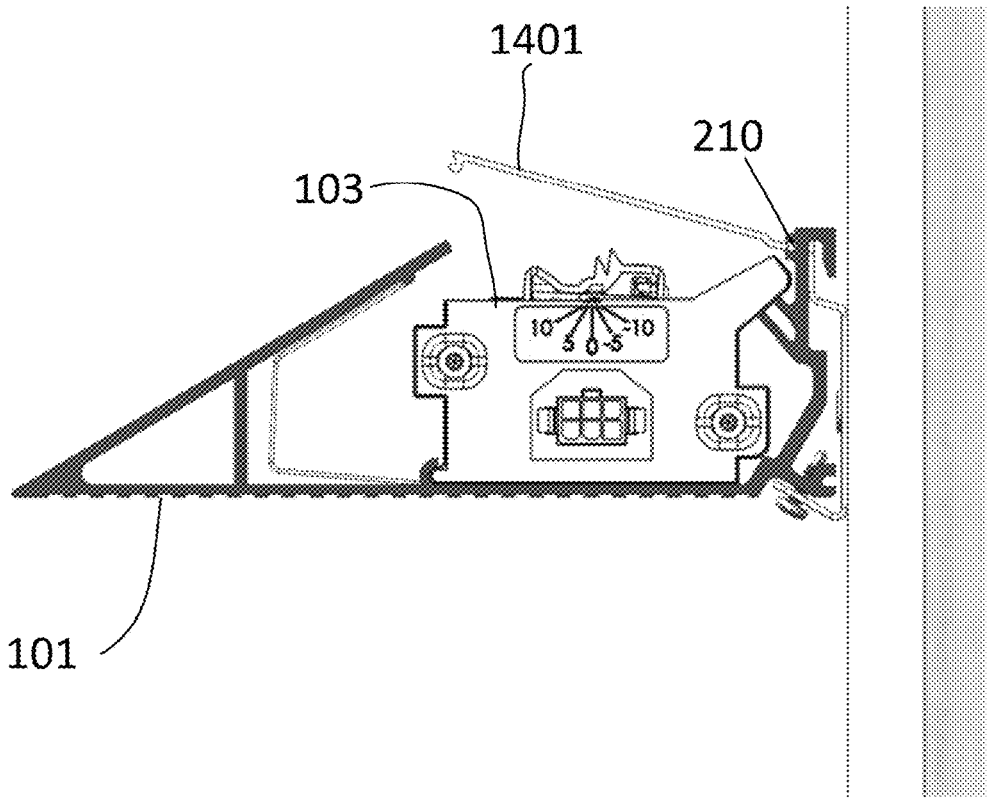
FIGS. 14A and 14B show views of steps of attaching a dust cover to a cove extrusion accordance with embodiments of the disclosed technology.
Figure 14B:
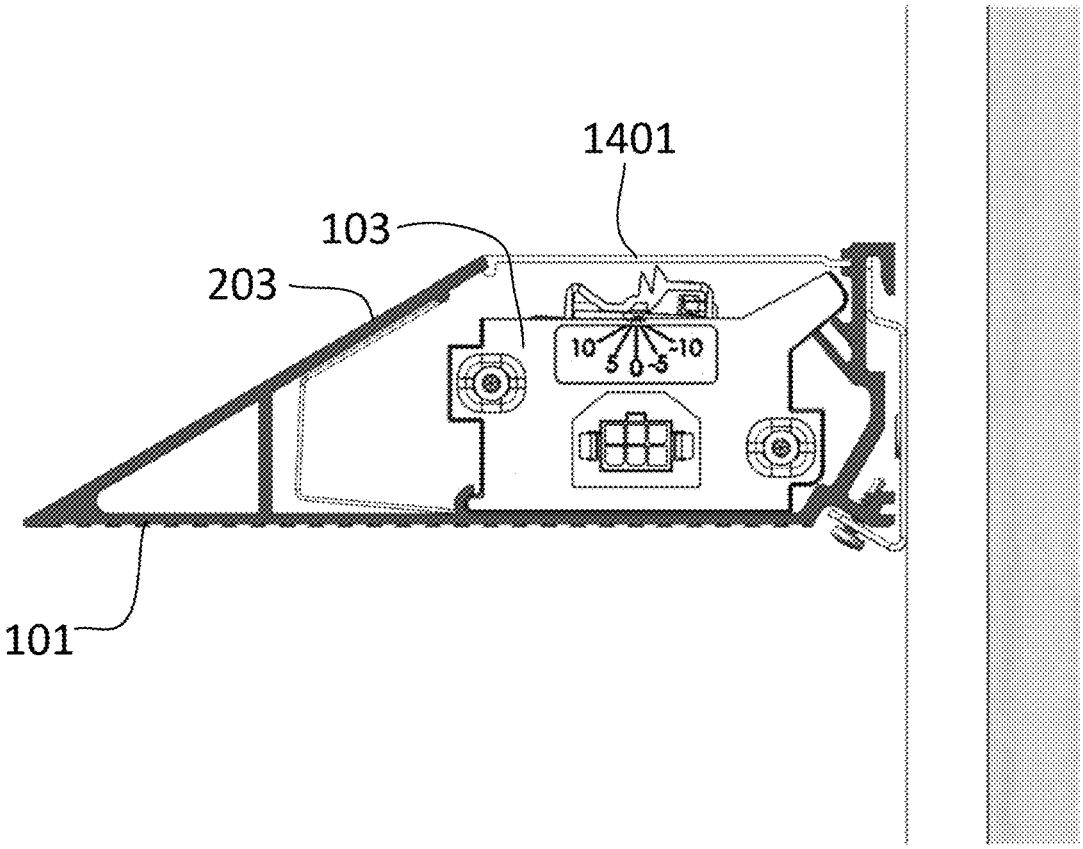
Figure 14C:
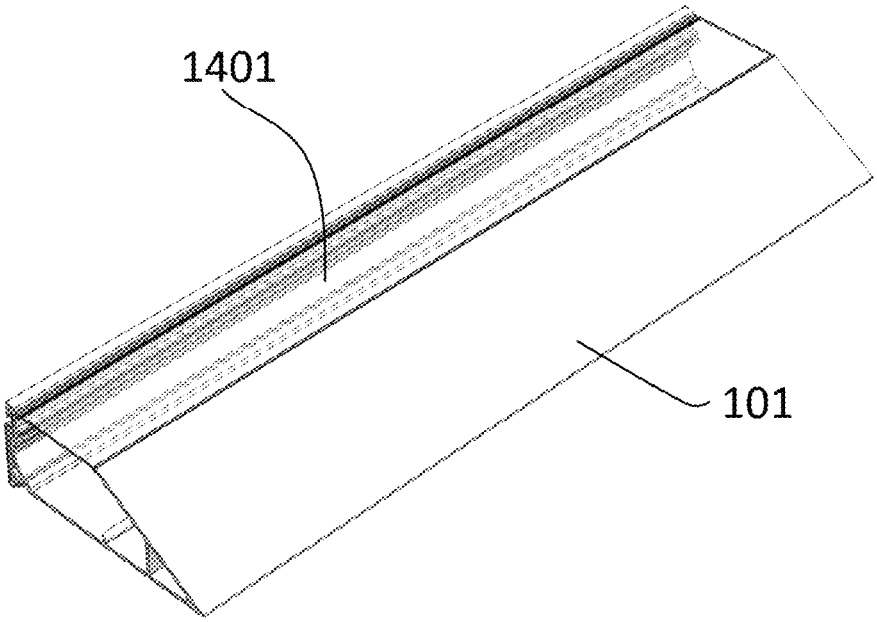
FIGS. 14C-14F show views of embodiments of cove extrusions with dust covers in accordance with embodiments of the disclosed technology.
Figure 14D:
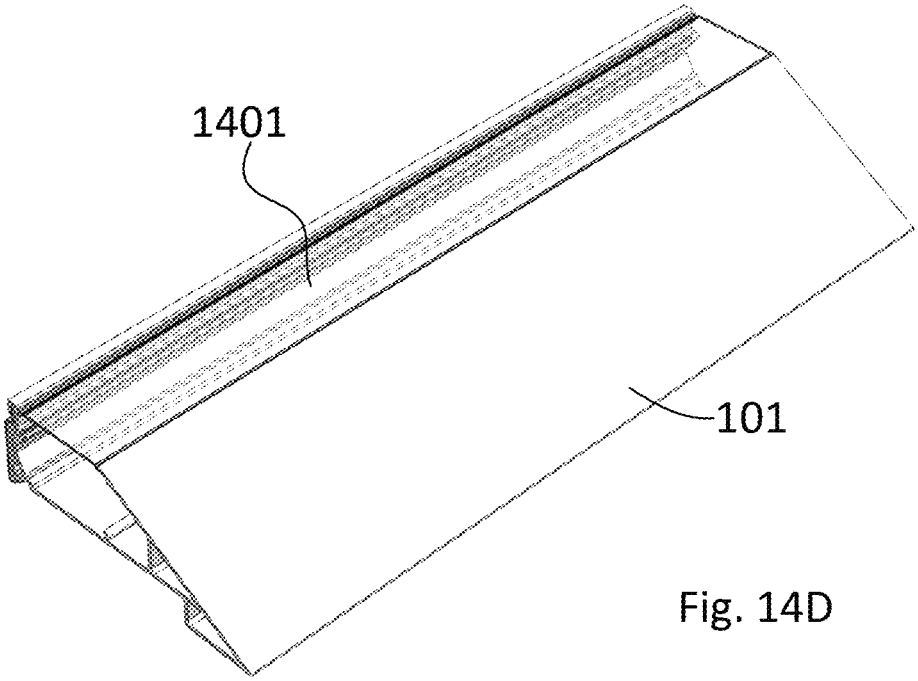
Figure 14E:
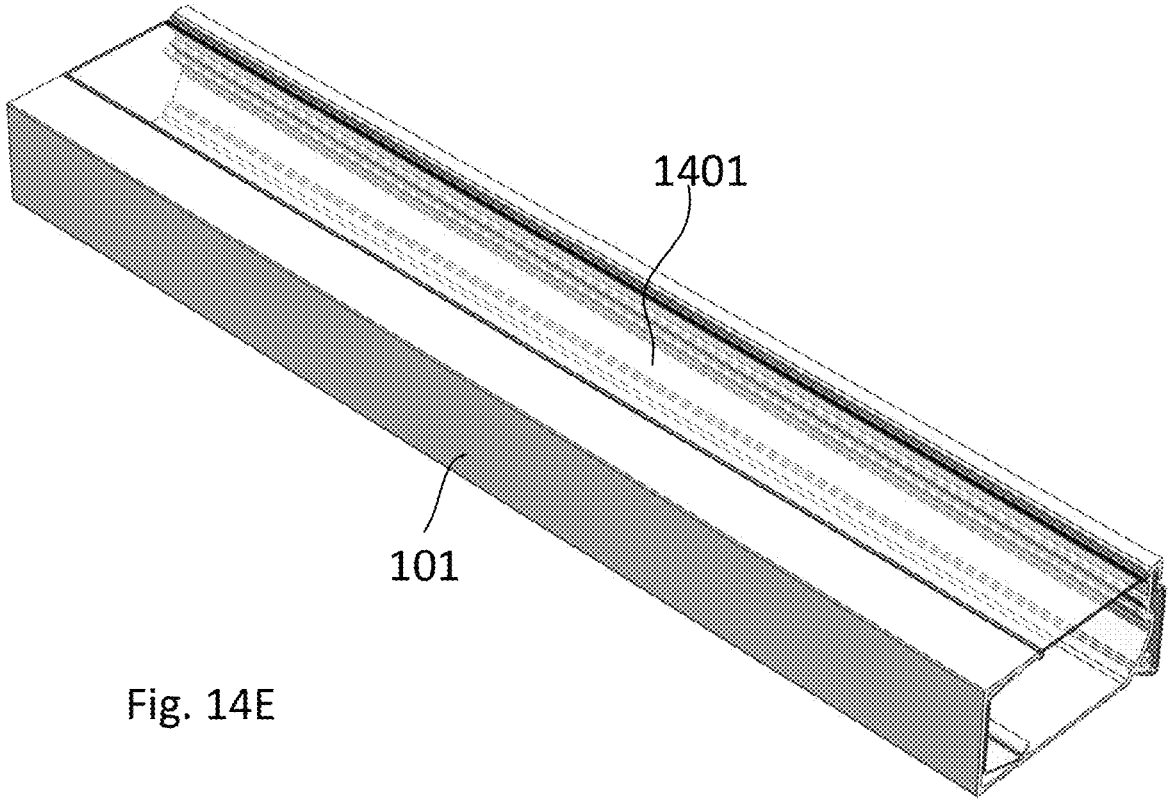
Figure 14F:
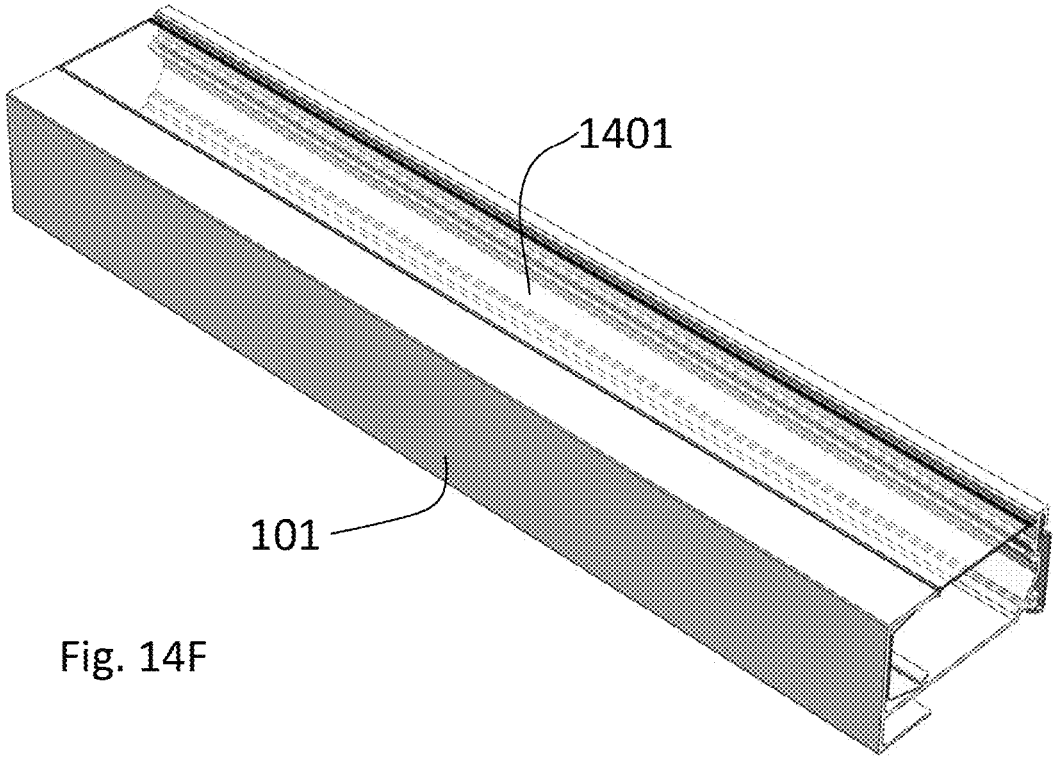

After the power boxes and luminaries are positioned within the cove channel, one or more dust covers 1401 may be secured to the cove extrusions 101. In embodiments, the dust covers may be transparent or frosted. To install the dust cover 1201, a rear edge of a dust cover may be placed in the dust cover channel 210, as shown in FIG. 14A, and the dust cover 1401 may be rotated so that a front edge snaps under and upper edge of the front wall 203, as shown in FIG. 14B.

A dust cover 1401 may have same length as a single cove extrusion 101, for example as shown in FIGS. 14C-14F.

Figure 15A:
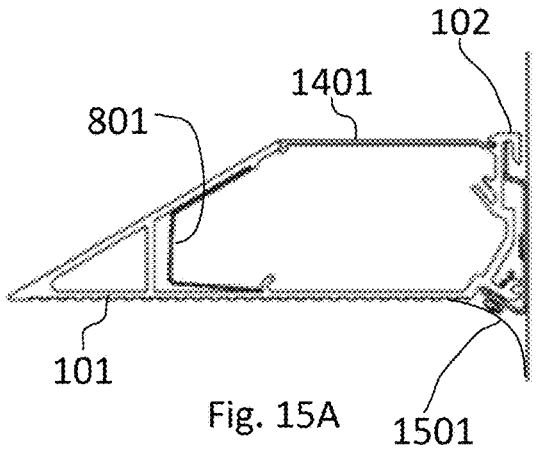
FIGS. 15A-15D show views of embodiments of cove extrusions attached to building wall and prepared for a skim coat to be applied in accordance with embodiments of the disclosed technology.
Figure 15B:
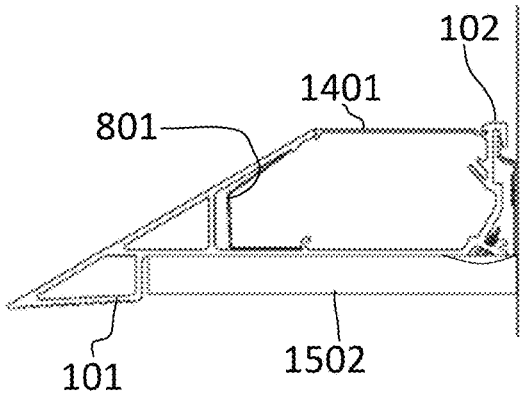
Figure 15C:
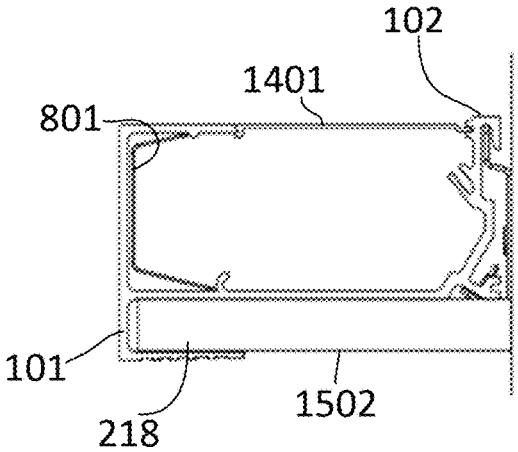
Figure 15D:
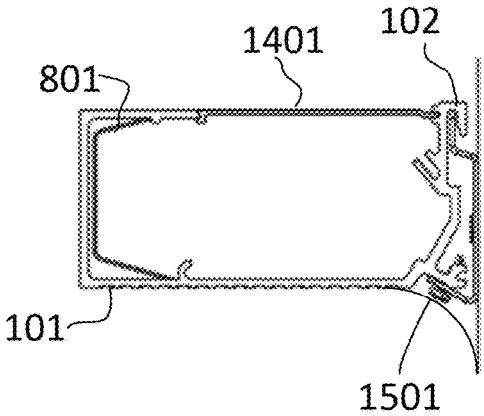

FIGS. 15A-15D show profile views of different embodiments of cove extrusions sub-assemblies, with the cove extrusions 101 secured to the mounting brackets 102, with the spring clip 801 and dust cover 1401 in place, with the power boxes and luminaires omitted for clarity. FIG. 15A shows a knife edge mud-in cove extrusion. A strip of tape 1501 may be adhered to the outer surface of the bottom wall 202 and the building wall in order to cover the interface of the mounting bracket and the cove extrusion. A skim coat of mud may be applied on the outer surface of the bottom wall 202, the tape and the building wall to create a smooth hardware-less transition from the building wall to the cove extrusion. FIG. 15B shows a knife edge drywall cove extrusion. A strip of wallboard 1502 may be adhered to the outer surface of the bottom wall 202, and a skim coat of mud may be applied on the front bottom wall 214, the wallboard and the building wall to create a smooth hardware-less transition from the building wall to the cove extrusion. FIG. 15C shows a square edge drywall cove extrusion. A strip of wallboard 1502 may retained in the wallboard channel 218, and a skim coat of mud may be applied on the front bottom wall 214, the wallboard and the building wall to create a smooth hardware-less transition from the building wall to the cove extrusion. FIG. 15D shows a square edge mud-in cove extrusion. In embodiments, a cove extrusion may have any combination of features of the cove extrusions disclosed herein.

Figure 16A:
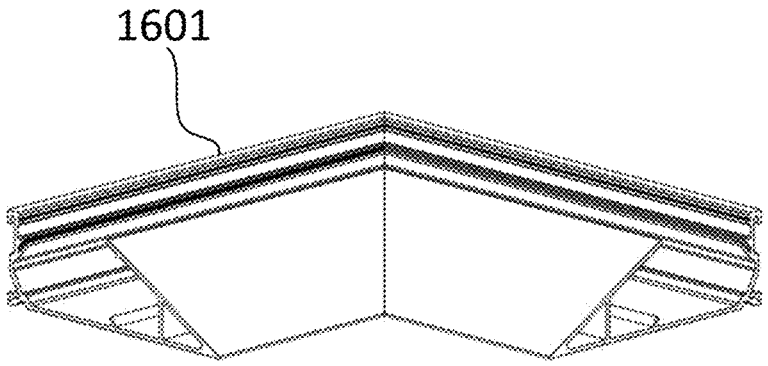
FIGS. 16A and 16B show views of embodiments of corner cove extrusions in accordance with embodiments of the disclosed technology.
Figure 16B:
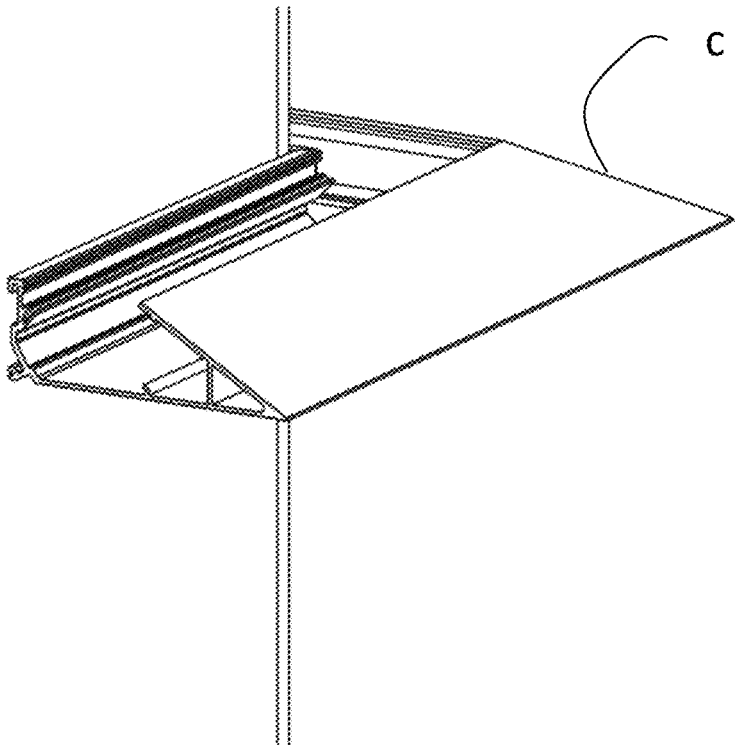
Figure 17A:
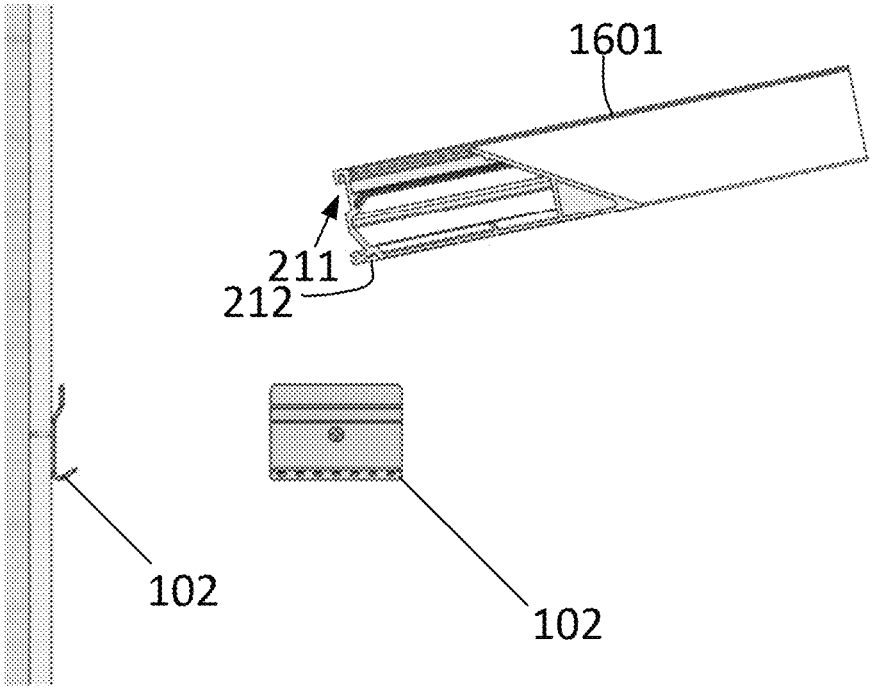
FIGS. 17A and 17B show views of steps of attaching a corner cove extrusion to a building wall in accordance with embodiments of the disclosed technology.
Figure 17B:
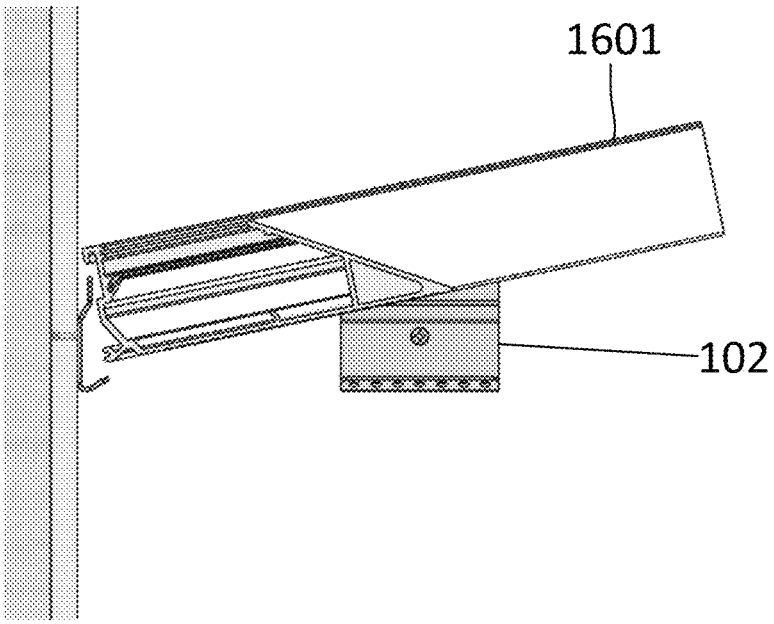

In embodiments, systems may include corner cove extrusions 1601, for example an inner corner cove extrusion, as shown for example in FIG. 16A, or an outer cove extrusion, as shown for example in FIG. 16B. The corner cove extrusions 1601 may comprises a first extrusion leg and a second extrusion leg coupled at an angle relative to the first extrusion leg. The angle may be between 1 and 179 degrees. The legs of a corner cove extrusion may be separately extruded, then cut with at the desired angle, and then welded together to form a mitre joint. The corner cove extrusions 1601 may be attached to a building wall prior to attaching straight cove extrusions to the building wall adjacent to the corner cove extrusions, as shown in FIGS. 17A and 17B. The corner cove extrusions may be aligned with adjacent cove extrusions with a spring clip, as disclosed above.

Figure 18A:
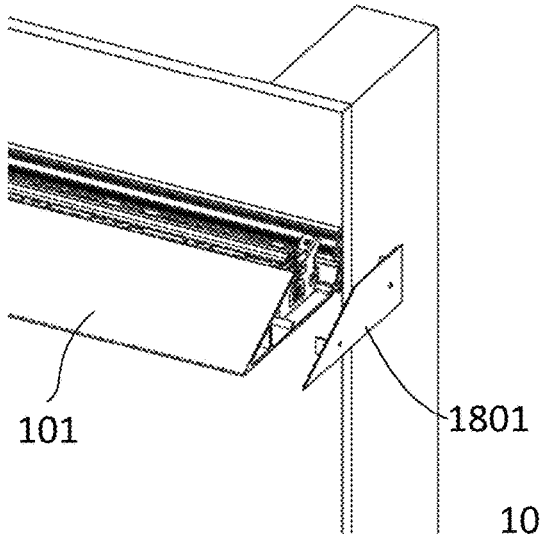
FIGS. 18A-18D show views of steps of attaching an end cap to a cove extrusion in accordance with embodiments of the disclosed technology.
Figure 18B:
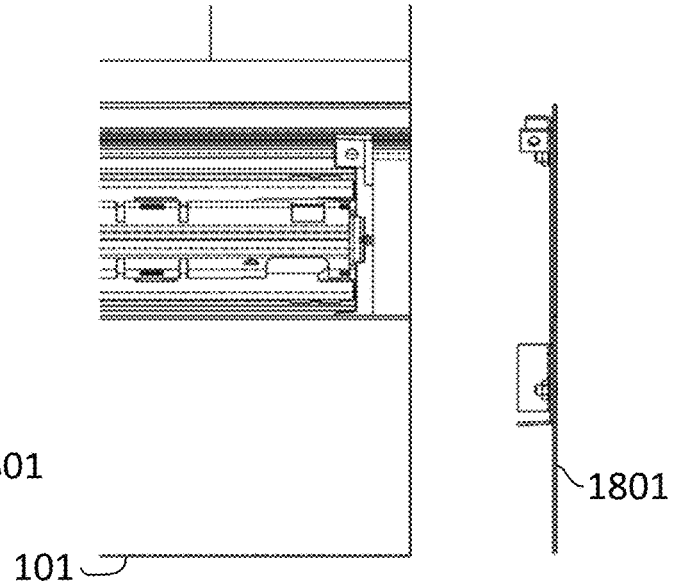
Figure 18C:
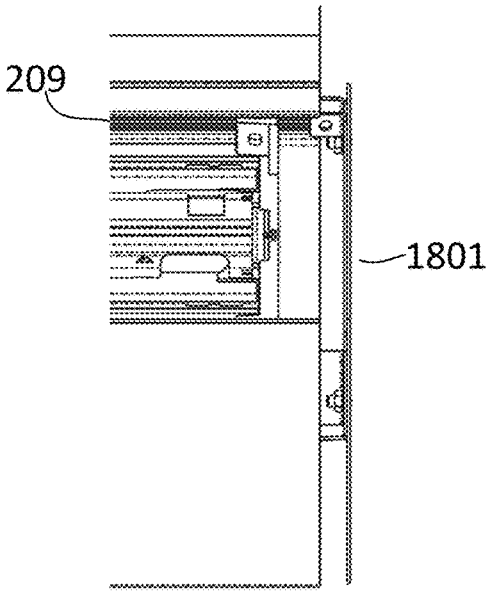
Figure 18D:
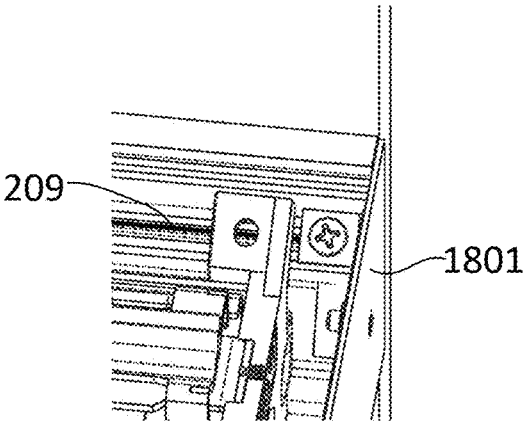

In embodiments, a system may include end caps 1801 as shown in FIGS. 18A-D. The end cap is sized and shaped to match the side profile of a cove extrusion. The end cap 1801 may be secured to a cove extrusion 101 with a fastener 1802 into the fastener channel 209 as shown in FIG. 18D. The end cap may be sealed with caulk to prevent light escaping out the end of the cove extrusion.

Figure 19A:
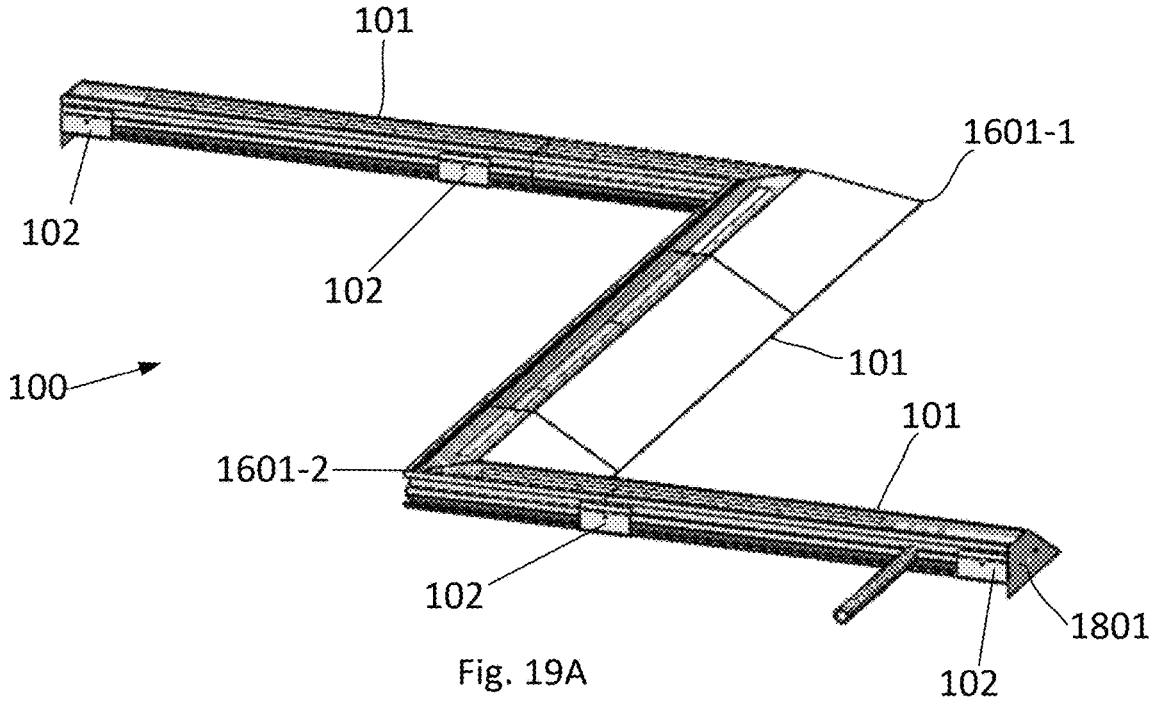
FIGS. 19A and 19B show views of embodiments of a cove lighting system in accordance with embodiments of the disclosed technology.
Figure 19B:
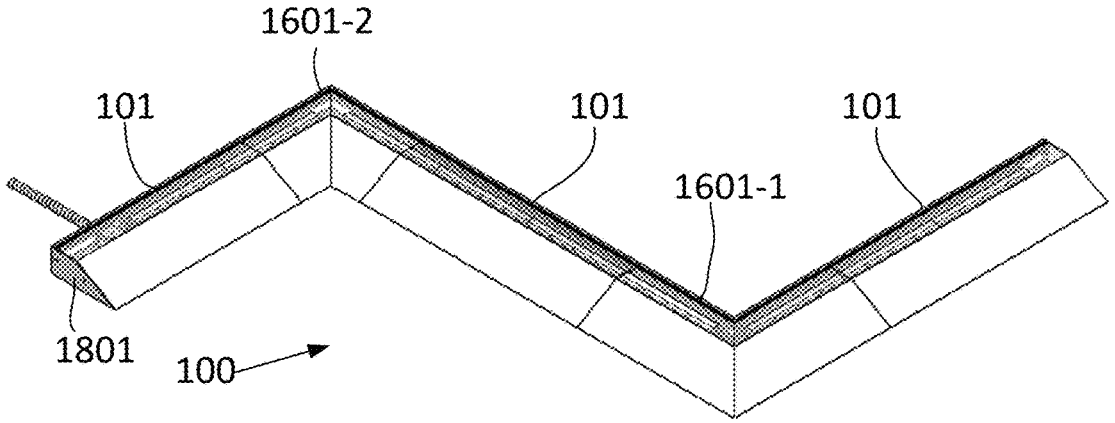

FIGS. 19A and 19B show an embodiment of a system 100 including straight cove extrusions 101, outer corner cove extrusions 1601-1, inner corner cove extrusions 1601-2, and end caps 1801. As shown, one of the cove extrusions comprises a notch to receive the conduit for the power box, and the other cove extrusions in the system may be notchless. Each of the cove extrusions houses one or more serially connected luminaires. In embodiments, a plurality of adjacently connected cove extrusions may contain more than one power box, wherein each power box provides power to a separate run of a plurality of luminaires.

Figure 20A:
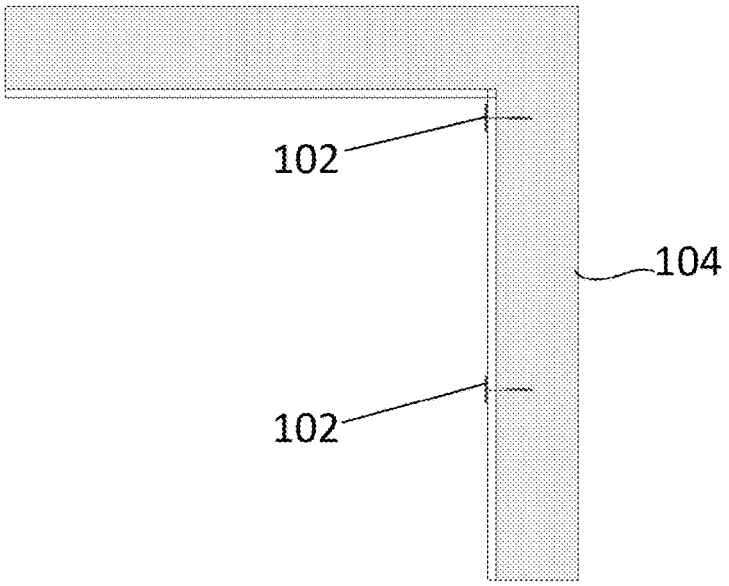
FIGS. 20A-20C show views of steps of attaching a cove extrusion vertically to a building wall in accordance with embodiments of the disclosed technology.
Figure 20B:
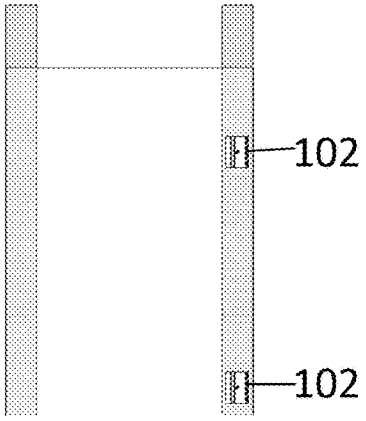
Figure 20C:
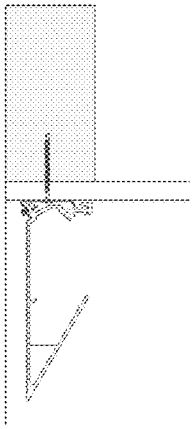

FIGS. 7A-7E show a method of attaching a cove extrusion to a building wall with the cove extrusion generally horizontal and the cove channel facing upwardly, for example toward a ceiling. However, in embodiments cove extrusions may be mounted to a building wall, ceiling, floor, or any other building surface at an angle other than horizontal, and the cove channel may face the ceiling, the floor, a wall, or a combination thereof. For example the cove extrusions may be mounted vertically in order to direct ambient light into a corner of a room. FIGS. 20A and 20B show mounting brackets 102 attached in a vertical line on a building wall 104, and FIG. 20C shows a top view of a cove extrusion mounted vertically to a building wall. In embodiments, cove extrusions may be mounted at an oblique angle, for example along a wall under an angled ceiling of a stairwell.

The various aspects, embodiments, implementations or features of the described embodiments can be used separately or in any combination. In particular, it should be appreciated that the various elements of concepts from FIGS. 1A-20C may be combined without departing from the spirit or scope of the invention.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, or gradients thereof, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained.

Preferred embodiments of this invention are described herein, including the best mode known to the inventors for carrying out the invention. The invention is susceptible to various modifications and alternative constructions, and certain shown exemplary embodiments thereof are shown in the drawings and have been described above in detail. Variations of those preferred embodiments, within the spirit of the present invention, may become apparent to those of ordinary skill in the art upon reading the foregoing description. The inventors expect skilled artisans to employ such variations as appropriate, and the inventors intend for the invention to be practiced otherwise than as specifically described herein. Accordingly, it should be understood that there is no intention to limit the invention to the specific form or forms disclosed, but on the contrary, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context. The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of specific embodiments are presented for purposes of illustration and description. They are not intended to be exhaustive or to limit the described embodiments to the precise forms disclosed. It will be apparent to one of ordinary skill in the art that many modifications and variations are possible in view of the above teachings.

What is claimed is:

1. A cove lighting system comprising:

at least one cove extrusion, wherein each of the at least one cove extrusions comprises:

a rear wall;

a bottom wall; and a front wall;

wherein the rear wall, the bottom wall, and the front wall are formed in a single extrusion, wherein interior surfaces of the rear wall, the bottom wall, and the front wall define a cove channel;

wherein an exterior surface of the rear wall defines a bracket channel;

at least one luminaire positioned within the cove channel; and at least one mounting bracket, wherein each of the at least one mounting brackets comprises an upper portion and a central portion, wherein the upper portion is configured to be received in the mounting channel, and wherein the central portion defines a hole configured to receive a fastener in order to attach the mounting bracket to a building wall so that the cove extrusion can be hung on the mounting bracket;

wherein the interior surface of the bottom wall comprises a first retaining flange extending along a length of the cove channel and formed in the single extrusion, wherein each of the at least one luminaires comprises a foot flange positioned under the first retaining flange;

the interior surface of the rear wall defines a fastener channel extending along the length of the cove channel and formed in the simile extrusion, wherein each of the at least one luminaires comprises a top flange attached to the fastener channel with a fastener;

further comprising a power box positioned within the cove channel and electrically coupled to the at least one luminaire; wherein the power box comprises a second foot flange positioned under the first retaining flange and a second top flange attached to the fastener channel with a second fastener;

wherein a first cove extrusion of the at least one cave extrusions defines a notch in the rear wall of the first cove extrusion, wherein the power box is coupled to a conduit positioned within the notch.

2. The wall mounted cove lighting system of claim 1, further comprising an end cap, wherein the end cap is sized and shape to match a profile of an end of the one or more cove extrusions, and wherein the end cap is attached to the end of the cove extrusion with a third fastener threaded into the fastener channel.

3. The wall mounted cove lighting system of claim 2, further comprising a spring clip, wherein the interior surface of the front wall comprises a second retaining flange extending along the length of the cove channel and formed in the single extrusion, wherein the spring clip is positioned within the cove channels of two adjacent cove extrusions of the one or more cove extrusions, and wherein the spring clip is retained within the cove channels between the first retaining flanges and the second retaining flanges of the two adjacent cove extrusions.

4. The wall mounted cove lighting system of claim 3, wherein the spring clip is u-shaped and comprises a middle section, an upper leg and a lower leg, and wherein the upper leg and the lower leg comprise teeth contacting the first and second retaining flanges in order to ground the adjacent cove extrusions.

5. The wall mounted cove lighting system of claim 1, wherein the exterior surface of the rear wall comprises a clamping surface, wherein the at least one mounting bracket comprises a lower portion defining a lower mounting channel;

wherein the clamping surface is positioned in the lower mounting channel and a fourth fastener extends through the lower portion and into the clamping surface in order to secure the cove extrusions to the mounting bracket.

6. The wall mounted cove lighting system of claim 1, further comprising:

a corner cove extrusion, wherein the corner cove extrusion comprises a first cove extrusion leg and a second cove extrusion leg, wherein the first cove extrusion leg and the second cove extrusion leg of coupled at an angle so that the corner cove extrusion is configured to be attached to a corner of the building wall.

7. The wall mounted cove lighting system of claim 1, wherein each of the at least one cove extrusion comprises:

a front bottom wall coupled to the front wall, wherein the front wall and the front bottom wall define a wallboard channel facing toward the rear wall and configured to retain a strip of wallboard covering the exterior surface of the bottom wall.

8. The wall mounted cove lighting system of claim 1, wherein each of the at least one mounting brackets are configured to be attached to the building wall along a horizontal line in order to support the at least one cove extrusion in a horizontal orientation.

9. The wall mounted cove lighting system of claim 1, wherein each of the at least one mounting brackets are configured to be attached to the building wall along a vertical line in order to support the at least one cove extrusion in a vertical orientation.

10. A method of mounting the cove lighting system of claim 1, the method comprising:

attaching a first mounting bracket and a second mounting bracket of the at least one mounting brackets with the fasteners extending through the holes in the central portions into the building wall; and hanging a first cove extrusion, of the at least one cove extrusions, on the first and second mounting brackets by placing the bracket channel of the first cove extrusion over the upper portions of the first and second mounting brackets.

11. The method of claim 10, the method further comprising:

attaching a third mounting bracket of the at least one mounting brackets with the fasteners extending through the hole in the central portion into the building wall; and hanging a second cove extrusion, of the at least one cove extrusions, wherein hanging the second cove extrusion comprises placing the bracket channel of the second cove extrusion over the upper portion of the third mounting bracket.

12. The method of claim 11, the method further comprising:

attaching a fourth mounting bracket of the at least one mounting brackets with the fasteners extending through the hole in the central portion into the building wall, wherein hanging the second cove extrusion further comprises placing the bracket channel of the second cove extrusion over the upper portion of the fourth mounting bracket.

13. The method of claim 11, wherein hanging the second cove extrusion further comprises placing the bracket channel of the second cove extrusion over the upper portion of the second mounting bracket.

14. The method of claim 11, further comprising:

placing a spring clip within the cove channels of the first cove extrusions and the second extrusion, wherein the interior surface of the bottom walls of the first and second cove extrusions each comprise a first retaining flange extending along a length of the cove channel and formed in the single extrusion, wherein the interior surface of the front walls of the first and second cove extrusions each comprise a second retaining flange extending along the length of the cove channel and formed in the single extrusion, wherein the spring clip is retained within the cove channels between the first retaining flanges and the second retaining flanges.

15. The method of claim 14, further comprising:

placing a power box within the cove channel of the first cove extrusion, wherein the power box comprises a foot flange and a top flange, placing the foot flange of the power box under the first retaining flange;

rotating the power box with the foot flange under the first retaining flange so that the top flange of the power box contacts a fastener channel defined by the interior surface of the rear wall; and securing the top flange of the power box to the fastener channel.

16. The method of claim 15, wherein each of the at least one luminaires comprises a foot flange and a top flange, wherein the method further comprises:

placing the foot flange of a first luminaire, of the at least one luminaires, under first retaining flange;

rotating the first luminaire with the foot flange under the first retaining flange so that the top flange of the first luminaire contacts the fastener channel;

securing the top flange of the first luminaire to the fastener channel; and coupling the first luminaire to the power box.

* * * * *